US009447580B2

(12) United States Patent
Points et al.

(10) Patent No.: US 9,447,580 B2
(45) Date of Patent: Sep. 20, 2016

(54) COVERED FLANGE BRACE AND FLANGE BRACE COVER

(71) Applicant: Bay Insulation Systems Inc., Green Bay, WI (US)

(72) Inventors: Calvin R. Points, Seguin, TX (US); Timothy Pendley, Madera, CA (US); Michael J. McLain, Green Bay, WI (US)

(73) Assignee: Bay Insulation Systems, Inc., Green Bay, WI (US)

( * ) Notice: Subject to any disclaimer, the term of this patent is extended or adjusted under 35 U.S.C. 154(b) by 0 days.

(21) Appl. No.: 14/642,216

(22) Filed: Mar. 9, 2015

(65) Prior Publication Data

US 2015/0259907 A1 Sep. 17, 2015

Related U.S. Application Data

(60) Provisional application No. 61/951,505, filed on Mar. 11, 2014.

(51) Int. Cl.
*E04C 2/52* (2006.01)
*E04B 7/02* (2006.01)
(Continued)

(52) U.S. Cl.
CPC ..... *E04B 7/024* (2013.01); *E04D 12/002* (2013.01); *E04D 13/1625* (2013.01); *E04B 2001/249* (2013.01); *E04B 2001/2487* (2013.01); *E04G 21/3261* (2013.01)

(58) Field of Classification Search
CPC .... E04B 7/024; E04B 1/7654; E04D 12/002
USPC ..... 52/220.8
See application file for complete search history.

(56) References Cited

U.S. PATENT DOCUMENTS 3,969,863 A * 7/1976 Alderman ..... E04D 3/3602 52/407.4
4,047,346 A * 9/1977 Alderman ..... E04D 15/06 52/127.5

(Continued)

FOREIGN PATENT DOCUMENTS

WO WO 2012/145783 11/2012

OTHER PUBLICATIONS

Silvercote Lamination, ES Energy Saver FP, brochure, Copyright 2014, 20 pages, Silvercote Laminations, Greer, South Carolina.

(Continued)

*Primary Examiner* — Brian Mattei
*Assistant Examiner* — Gisele Ford
(74) *Attorney, Agent, or Firm* — Thomas D. Wilhelm; Northwind IP Law, S.C.

(57) ABSTRACT

A building roof structure includes rafters, purlins, braces, and a suspension fabric. The suspension fabric, which may be part of a fall protection system, insulation support system, and/or vapor barrier system, extends across a bay or other portion of the roof structure such that the suspension fabric is above the rafters and below the purlins. The braces connect at least some of the purlins to at least some of the rafters, and each brace extends through a corresponding slit or other opening in the suspension fabric. Brace covers are provided for some or all of the braces to conceal the fabric opening, to facilitate sealing around the brace near the fabric opening, and/or to provide support for the suspension fabric near the fabric opening.

30 Claims, 29 Drawing Sheets

(51) Int. Cl.

| | |
|---|---|
| ***E04D 12/00*** | (2006.01) |
| ***E04D 13/16*** | (2006.01) |
| *E04G 21/32* | (2006.01) |
| *E04B 1/24* | (2006.01) |

(56) References Cited

U.S. PATENT DOCUMENTS 4,069,636 A * 1/1978 Kessler ..... E04B 1/76 52/357
4,075,807 A * 2/1978 Alderman ..... E04D 13/1625 156/576
4,147,003 A * 4/1979 Alderman ..... E04D 3/3602 52/309.8
4,318,260 A * 3/1982 Siegel ..... E04D 13/1637 52/407.4
4,408,423 A * 10/1983 Lautensleger ..... E04B 7/024 52/90.1
4,446,664 A * 5/1984 Harkins ..... E04D 12/00 52/404.3
4,573,298 A * 3/1986 Harkins ..... E04D 12/00 52/404.3
4,635,423 A * 1/1987 Ward ..... E04B 1/642 156/71
4,637,188 A * 1/1987 Crothers ..... E04D 13/1618 52/404.2
4,711,060 A * 12/1987 Scherrer ..... B44C 7/022 52/220.8
4,875,320 A * 10/1989 Sparkes ..... E04D 13/1625 52/22
5,357,722 A * 10/1994 Kessler ..... E04B 7/022 52/198
5,406,764 A * 4/1995 Van Auken ..... E04D 13/1618 52/408
5,901,518 A * 5/1999 Harkins ..... E04B 7/024 52/404.3
5,953,875 A * 9/1999 Harkins ..... E04B 1/62 160/392
6,003,282 A * 12/1999 Alderman ..... E04G 21/3214 160/391
6,041,568 A * 3/2000 Alderman ..... E04D 15/06 242/557
6,226,945 B1 * 5/2001 Henry ..... E04B 7/00 52/3
6,247,288 B1 * 6/2001 Harkins ..... E04D 15/06 52/746.11
6,363,684 B1 * 4/2002 Alderman ..... E04D 15/06 52/404.3
6,393,797 B1 * 5/2002 Romes ..... B65H 16/00 242/566
6,401,426 B1 * 6/2002 Alderman ..... E04D 15/06 52/745.06
6,595,455 B2 * 7/2003 Romes ..... B65H 16/08 242/422.5
6,769,223 B2 * 8/2004 Alderman ..... E04D 15/06 242/557
7,114,301 B2 * 10/2006 Bibaud ..... E04D 13/1476 285/42
7,448,836 B2 * 11/2008 Clarke ..... B60P 7/0876 410/118
7,797,905 B1 * 9/2010 Smalley ..... E04B 7/024 52/478
8,479,455 B2 * 7/2013 Schaefer ..... E04D 13/1476 174/564
8,528,301 B1 * 9/2013 Robbins ..... E04D 13/1625 242/566
8,590,245 B2 11/2013 Peng et al.
8,844,230 B2 * 9/2014 Harkins ..... E04B 1/342 52/404.1
2002/0020584 A1 2/2002 Cjepa
2002/0124507 A1 * 9/2002 Atkins ..... E04D 12/002 52/408
2003/0114055 A1 6/2003 Burton et al.
2003/0167718 A1 * 9/2003 Alderman ..... E04D 13/1618 52/407.3
2010/0005749 A1 * 1/2010 Abdel-Sayed ..... E04B 1/24 52/650.2
2010/0024325 A1 * 2/2010 Robbins ..... E04D 12/002 52/173.1
2011/0061311 A1 * 3/2011 Peng ..... E04D 13/1618 52/23
2011/0067345 A1 * 3/2011 Crostic, Jr. ..... E04D 12/002 52/698
2011/0258955 A1 * 10/2011 McCarron ..... E04B 1/7666 52/408

OTHER PUBLICATIONS

Guardian Building Products Distribution, Inc., Guardian ES Energy Saver FP, Product Specification Sheet, Copyright 2011, 2 pages, Guardian Building Products, Greer, South Carolina.
Harris Steel, Industry properties for Steel Sheets—Cold Rolled & Hot Dipped Zinc Coated, Specification Sheet, 2 pages, Harris Steel.
Steelscape, A Bluescope Steel Company, Zincalume Steel Grade 50 (Class 1), Grade Data Sheet, Jul. 1, 2012, 1 page, Steelscape.
Steelscape, A Bluescope Steel Company, Zincalume Steel Grade 80 (Class 1), Grade Data Sheet, Jul. 1, 2012, 1 page, Steelscape.
Maple Leaf Sales, K-Grip 514 Flammable Foam, Product Data Sheet, 1 page.
Maple Leaf Sales II, Inc., 514 Macroplast Adhesive, Material Safety Data Sheet, dated Jul. 16, 2010, 3 pages.

* cited by examiner

COVERED FLANGE BRACE AND FLANGE BRACE COVER

CROSS REFERENCE TO RELATED APPLICATIONS

This application claims the benefit of U.S. Provisional Patent Application Ser. No. 61/951,505 filed Mar. 11, 2014, the entirety of the preceding application being incorporated herein by reference in its entirety.

BACKGROUND OF THE INVENTION

This invention relates to buildings, building components, building subassemblies, and building assemblies, and to methods of constructing buildings. The invention has particular application to building roof structures that incorporate rafters, purlins, braces that connect rafters to purlins (e.g. to enhance structural integrity), and suspension fabrics. The suspension fabric may be part of a fall protection system, part of an insulation support system, and/or part of a vapor barrier system. The invention also relates to associated articles, systems, and methods.

From time to time, injuries occur during the construction of buildings, including to workers involved in such construction. Workers who are involved, in particular, in the construction of roof structures for buildings are at risk of injury that may result from falling from an elevated height. Standard and required systems and practices have been developed to protect such workers, for example to catch and support them if/when they fall. These systems and practices are referred to as fall protection systems.

One known fall protection system is a passive system wherein a fabric, such as a solid sheet, a woven sheet, or a net-like material, is suspended at or below the work area, optionally supported by a grid of crossing support bands, far enough above any underlying supporting surface to catch and support a worker who falls, thereby to act as a passive fall-protection system.

The Occupational Safety and Health Administration (OSHA) in the U.S. has defined a drop test procedure whereby such a passive fall protection system can be tested. According to the test procedure, a 400 pound weight is dropped onto the fall protection system under stated conditions to determine whether a given system meets the required safety standards. For purposes of complying with government regulations, any system used as a fall protection system need only meet the OSHA-mandated standards related to dropping such 400 pound weight. Of course, the real humanitarian objective is to prevent worker injuries if/when a worker falls from an elevated work location. Thus, any fall protection system which is effective to catch and safely hold a falling worker has operational value, even if such system does not meet OSHA standards.

According to one practice currently in use in the metal building industry, and intended to meet government fall protection standards, a purported fall protection system uses crossing longitudinal and lateral metal bands extending under the eave, under the ridge, and under the intermediate purlins of the roof structure of the building, and a fabric is installed above the bands and under the purlins, extending across the entirety of a respective bay of the building being constructed, thereby providing a suspended fabric intended to catch and support a falling worker in that bay. Insulation is ultimately installed on the top surface of the fabric whereby the fabric ultimately functions both as the vapor barrier portion of the building ceiling insulation system in the finished building and as a catch-and-support fabric in the fall protection system.

In some cases, the design of a building roof structure calls for flange braces to be installed between the rafters and purlins of the building support structure. In some cases, a flange brace has a lower end which attaches to the bottom flange of a rafter, and an upper end which attaches to a neighboring purlin which is supported by the rafter. Such flange braces can enhance the structural integrity of the corresponding roof structure of the building.

However, such flange braces can also pose a challenge to the installation of a large suspension fabric which extends across the bay of a building roof structure. As such a fabric is unfolded in order to extend the fabric along the length of the bay underneath a set of successive purlins, the flange braces may present obstacles to such unfolding and installation of the extended fabric. One known approach to this situation is to disconnect the upper ends of the braces from the respective purlins so that the suspension fabric can be extended, and, after the fabric is in place, attaching the upper ends of the braces to bottom surfaces of the respective purlins. This approach avoids having to create a large hole or opening in the suspension fabric that would be needed to re-attach the upper end of each brace to a more central part of the respective purlin; however, attachment of the brace to the bottom surface of the purlin can be contrary to the building specification, and is otherwise undesirable from a structural integrity standpoint.

In another known approach, the upper ends of the braces are again disconnected from the respective purlins, but, after the extended suspension fabric is in place in the bay beneath the purlins and above the braces, a large opening is cut in the suspension fabric at a location corresponding to each brace so that the upper end of the brace can be re-attached to the respective purlin through such opening. Pieces of patch tape are then applied to the lower surface of the suspension fabric to repair the openings. In some cases, a sealant is also applied at the repair points, e.g. to restore the ability of the suspension fabric (as repaired) to act as a vapor barrier. However, the pieces of patch tape applied to the suspension fabric are typically visible to occupants of the building, e.g. after construction of the roof structure and building is complete, and can be highly unattractive. Furthermore, the patch tape can work loose and delaminate over time with normal expansion and construction of the building components.

Accordingly, there is a need for a novel approach to the challenge of constructing building roof structures which incorporate both extended suspension fabrics (e.g. as part of a fall protection system, or for insulation support, or for use as a vapor barrier) and flange braces which connect rafters to purlins in the roof structure.

These and other needs are alleviated, or at least attenuated, or partially or completely satisfied, by novel products, systems, and/or methods of the invention.

SUMMARY

This invention provides brace covers suitable for use in building roof structures; systems and combinations involving such brace covers; methods of making and installing such brace covers, systems, and combinations; and buildings and roof structures which incorporate such brace covers, and kits which include a suspension fabric, banding for supporting the suspension fabric, and brace covers for covering openings in the suspension fabric through which braces will be extended.

For example, a building roof structure may include rafters, purlins, braces, and a suspension fabric. The suspension fabric, which may be part of a fall protection system and/or part of an insulation support system and/or part of a vapor barrier system, extends across a bay or other portion of the roof structure such that the suspension fabric extends onto the tops of the rafters but below the purlins. Braces connect at least some of the purlins to at least some of the rafters, and each brace extends through a corresponding slit or other opening in the suspension fabric. Brace covers are provided for some or all of the braces to conceal the fabric opening, to facilitate sealing around the brace near the suspension fabric opening to prevent passage of air through the suspension fabric opening, and/or to provide support for the suspension fabric near the suspension fabric opening.

In a first family of embodiments, the invention comprehends a building roof structure, comprising rafters and purlins, the purlins extending transversely across the rafters such that the rafters support the purlins; a suspension fabric extending across the roof structure such that the suspension fabric extends across the tops of the rafters and below the purlins; braces connecting at least some of the purlins to at least some of the rafters, each brace, and the respective purlin to which such brace connects, defining a brace/purlin combination, and each brace extending through a corresponding suspension fabric opening in the suspension fabric; and for each of at least some of the brace/purlin combinations, a brace cover having a cover opening through which the brace extends, the brace cover being disposed such that a portion of the suspension fabric is between the brace cover and the purlin.

In some embodiments, for at least some of the brace/purlin combinations, the purlin has a lower flange, and the brace cover is attached to the lower flange of the purlin.

In some embodiments, for at least some of the brace/purlin combinations, the purlin has a central web disposed between a purlin upper flange and a purlin lower flange, and the brace is attached to the central web of the purlin.

In some embodiments, at least some of the brace/purlin combinations further comprise a sealant applied around the brace and optionally into the cover opening in order to provide a barrier against ambient air flow through the cover at the cover opening.

In some embodiments, for at least some of the brace/purlin combinations, the brace cover has a perimeter which encompasses the suspension fabric opening.

In some embodiments, at least some of the brace/purlin combinations further comprise one or more pieces of tape applied to the suspension fabric to patch, to thereby at least partially close, the suspension fabric opening.

In some embodiments, a sealant bridges and seals a space between the brace cover and the suspension fabric.

In some embodiments, the sealant defines a closed loop path which is spaced from the suspension fabric opening, which closed loop path encompasses the suspension fabric opening.

In some embodiments, a perimeter of the brace cover defines a closed loop path which encompasses the closed loop path of the sealant.

In some embodiments, for at least some of the brace/purlin combinations, the brace cover comprises a plate, and the plate has a plate aperture which forms at least a portion of the cover opening.

In some embodiments, the plate of at least one of the brace covers has a 1-piece construction.

In some embodiments, the plate of at least one of the brace covers has a 2-piece construction.

In some embodiments, each plate which has the 2-piece construction has a first plate piece attached to a second plate piece, and the plate aperture in each such plate is partially defined by said first plate piece and partially defined by said second plate piece.

In some embodiments, plate aperture has a first L-shaped profile and, when the plate and brace are installed such that the plate is attached to the associated purlin and the brace is attached to the associated rafter and purlin, the plate aperture defines a reference plane, and a cross-section of the brace in the reference plane has a second different L-shaped profile.

In some embodiments, the L-shaped profile has first and second legs, and wherein the first leg is at least 1.5 inches long and the second leg is at least 1.5 inches long.

In some embodiments, the brace cover of at least some of the brace/purlin combinations also comprises a fabric piece attached to the plate and, when installation of the brace cover has been completed, the cover opening further comprises a fabric piece opening in the fabric piece, further comprising a sealant applied at a junction of the brace and the brace cover at the cover opening and optionally into the cover opening in order to provide a barrier against ambient air passing through the cover opening.

In some embodiments, the cover plate has first and second opposing major surfaces, the first major surface facing the purlin, and wherein the brace cover further comprises a fabric piece which covers the second major surface of the plate.

In some embodiments, the fabric piece is made of a same material as the suspension fabric.

In a second family of embodiments, the invention comprehends a building roof structure, comprising building structural roof elements including at least first and second rafters, a space between the first and second rafters defining a first distance between the first and second rafters, each rafter having a top, and opposing first and second ends, the roof structure further comprising an eave, having a length, and extending between the first ends of the first and second rafters, a ridge, having a length, and extending between the second ends of the first and second rafters, and a second distance between the eave and the ridge, the eave and the ridge being disposed on, extending transverse to, and being connected to, the tops of the first and second rafters, and a plurality of intermediate purlins extending between the first and second rafters and spaced from each other between the eave and the ridge, the intermediate purlins being disposed on, and extending transverse to, the tops of the first and second rafters, the building roof structure further comprising a first set of support bands extending from the first rafter to the second rafter and being connected to the building structural roof elements, the first set of support bands being spaced along the lengths of the first and second rafters; a second set of support bands extending from the eave toward the ridge and under the intermediate purlins, the second set of support bands having first and second end portions and being spaced from each other between the first and second rafters; a suspension fabric overlying, and being supported by, the first and second sets of support bands, the suspension fabric being securely attached to structural members of the building, a plurality of braces which collectively connect at least some of the intermediate purlins to one or both of the first and second rafters, each brace extending through a corresponding fabric opening in the suspension fabric; and for each brace which connects a given purlin to a given rafter, a brace cover having a cover opening through which the respective brace extends, the brace cover being attached to the given purlin and having a perimeter which encircles the fabric opening through which the brace extends.

In a third family of embodiments, the invention comprehends a brace cover suitable for use in a building roof structure which includes building roof structure braces, the brace cover comprising a plate having a thickness of at least 0.01 inch, and having an L-shaped aperture, the L-shaped aperture having a first leg at least 1.5 inches long and a second leg at least 1.5 inches long, such that the L-shaped aperture is sized to receive a building roof structure brace; and a fabric piece attached to the plate such that the fabric piece covers the aperture, the fabric piece also being imperforate at least in a region corresponding to the aperture such that the fabric piece seals the aperture.

In some embodiments, the second layer comprises a fabric piece made of a material suitable for use as a suspension fabric in a building fall protection system.

In some embodiments, the second layer has a layer perimeter and the plate has a plate perimeter, and wherein the second layer perimeter substantially matches the plate perimeter.

In some embodiments, the second layer is imperforate.

In a fourth family of embodiments, the invention comprehends a method of fabricating a building roof structure, comprising providing an initial building structure which includes columns, rafters supported by the columns, purlins supported by the rafters, and braces which connect at least some of the rafters to at least some of the purlins, each brace having an upper end which attaches to an associated purlin; detaching the upper ends of the braces from the associated purlins; laying out a suspension fabric across the roof structure above the rafters and below the purlins; and for a given brace, cutting a suspension fabric opening in the suspension fabric near the brace and the associated purlin, thereby to define a cover opening; guiding the upper end of the brace through the fabric opening in the suspension fabric, and re-attaching the upper end of the brace to the associated purlin; and attaching a brace cover to the associated purlin with a portion of the suspension fabric disposed between the brace cover and the purlin, the brace cover having a cover opening through which the brace extends.

In some embodiments, for a given brace, the attaching comprises passing the upper end of the brace through the cover opening before re-attaching the upper end of the brace to the associated purlin.

In some embodiments, the method further comprises, before the attaching the brace cover to the associated purlin, providing the brace cover in an initial state, the brace cover in the initial state including a plate and a fabric piece, the plate having a plate aperture, and the fabric piece being attached to the plate such that the fabric piece covers the plate aperture, the fabric piece being imperforate at least in a region corresponding to the plate aperture such that the fabric piece seals the plate aperture against free flow of ambient air through the fabric piece; and slitting the fabric piece in the region corresponding to the plate aperture to provide the cover opening.

In some embodiments, the method further comprises, for a given brace, after re-attaching of the upper end of the brace to the associated purlin, and before attaching the brace cover to the associated purlin, sliding the brace cover upwardly along the brace toward the associated purlin.

In some embodiments, for a given brace, assembling the brace cover about the brace and thereby defining a brace cover opening through which the brace extends.

In some embodiments, for a given brace, the brace cover comprises a plate having a plate aperture, the plate aperture being at least a portion of the cover opening, the plate also having a 2-piece construction comprising a first plate piece and a second plate piece, and wherein the assembling of the brace cover about the brace comprises joining the two plate pieces to each other and thereby forming the plate aperture about the brace.

In some embodiments, each brace cover has a perimeter and wherein, for a given brace, the attaching of the brace cover to the associated purlin comprises positioning the brace cover so that the perimeter of the brace cover encompasses the fabric opening.

In some embodiments, the invention further comprises, for a given brace, sealing the brace cover to the suspension fabric using a sealant in a closed loop path which is laterally spaced from the fabric opening and which encompasses the fabric opening.

In some embodiments, the invention further comprises, for a given brace, sealing the cover opening from ambient air flow by applying a sealant at a junction of the brace and the brace cover at the cover opening and optionally into the cover opening in order to provide a barrier against ambient air flow through the cover opening.

In a fifth family of embodiments, the invention comprehends a method of installing a brace cover on a brace in relation to a building roof structure, the method comprising providing a brace cover in an initial state, the brace cover in the initial state including a plate and a fabric piece, the plate having a plate aperture, and the fabric piece being attached to the plate such that the fabric piece covers the plate aperture, the fabric piece being imperforate at least in a region corresponding to the plate aperture such that the fabric piece seals the plate aperture; providing a brace having a first end; forming a slit in the fabric piece in the region corresponding to the plate aperture; and passing the first end of the brace through the slit and through the plate aperture.

In some embodiments, the brace has a second end opposite the first end, and wherein the second end is secured to building roof support structure under the building roof structure during the passing of the first end of the brace through the slit and through the plate aperture.

In some embodiments, the brace has an L-shaped cross-section, and wherein the forming of the slit forms the slit in an L-shape configuration.

In a sixth family of embodiments, the invention comprehends a suspension fabric kit, comprising a length of support banding suitable for extending a first set of support bands from a first rafter of a building to a second rafter of such building, and a second set of support bands, for crossing the first set of support bands and extending from an eave of such building, under intermediate purlins, to a ridge of such building; a suspension fabric suitable for extending from such first rafter to such second rafter and from such eave to such ridge, with the first and second sets of support banding supporting the suspension fabric; and a plurality of brace covers adapted and configured to extend about braces which are secured to ones of such rafters and ones of such purlins, and wherein such braces extend through apertures in the brace covers, the brace covers, in combination with sealants applied to the brace covers, bridging edges of the brace cover apertures and surfaces of such braces, and thereby providing a barrier against flow of ambient air through the respective cover apertures.

Related methods, systems, and articles are also discussed.

These and other aspects of the present application will be apparent from the detailed description below. In no event, however, should the above summaries be construed as limitations on the claimed subject matter, which subject matter is defined solely by the attached claims, as may be amended during prosecution.

BRIEF DESCRIPTION OF THE DRAWINGS

Illustrative embodiments of the invention are described hereinafter, by way of example only, with reference to the accompanying drawings, wherein.

Figure 1:
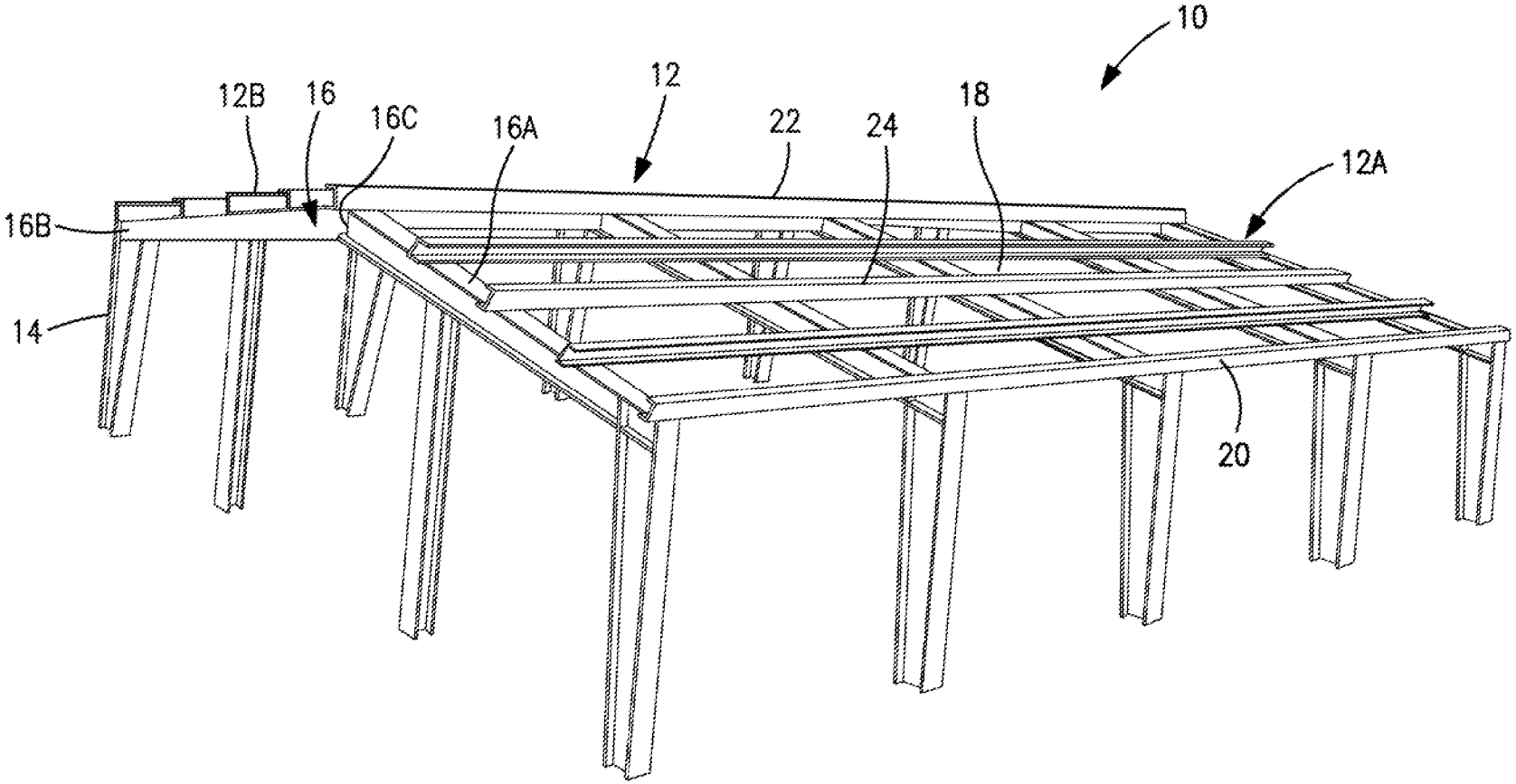
FIG. 1 is a perspective view, from above the eaves, of a typical metal building support structure, including columns, rafters, eaves, ridges, and intermediate purlins.

The invention is not limited in its application to the details of construction, or to the arrangement of the components or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

The description below, begins with a discussion in FIGS. 1-7 of certain metal buildings and certain fall protection systems for such buildings, so as to provide context for later discussion relating more specifically to flange braces and brace covers for use with the flange braces. The reader will understand that although the disclosed brace covers can be used in the fall protection systems which are specifically described, the brace covers can also be used in other fall protection systems, as well as in other building structures that may not include a fall protection system.

FIG. 1 illustrates the primary structural members of a typical metal building 10 having first and second roof slopes 12A and 12B. Vertical support for the structural elements of the roof, designated generally as 12, is provided by upstanding columns 14 positioned along side walls and end walls of the building. Rafters 16 overlie the tops of the columns and are supported by the columns. Rafters 16 span the width of the building, creating a series of open spaces between rafters 16, the open spaces being commonly referred to as "bays" 18 in the construction arts, the bays representing distances between respective ones of the rafters. Each rafter has an upper surface 16A, and opposing first 16B and second 16C ends.

According to the embodiments illustrated in FIGS. 1-4, eaves 20, expressing "C"-shaped cross-sections, are positioned at the down-slope ends of the rafters 16. Lengths of the eaves extend along the length of the building, above the outer wall of the building. The eaves provide lateral support to the skeletal structure of the building between respective ones of the columns 14, at the outer building wall. A given eave extends between the first ends 16B of respective ones of the rafters.

Figure 4:
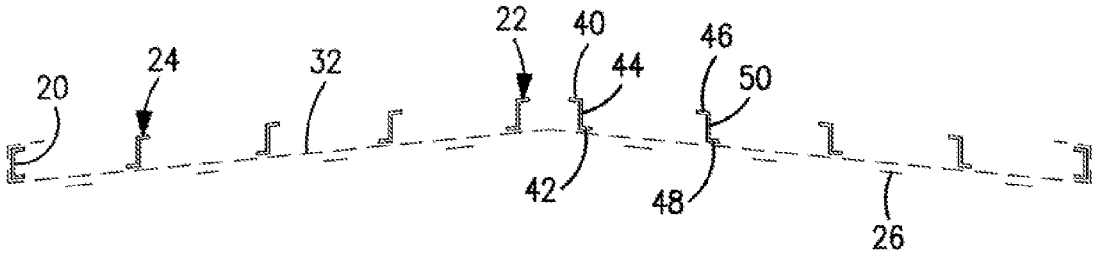
FIG. 4 is a diagrammatic end view of a roof structure of a metal building, showing longitudinal band spacing with respect to the eaves, the ridges, and the intermediate purlins.

Ridge members 22, expressing "Z"-shaped cross-sections as illustrated in FIG. 4, have lengths which overlie, and are attached to, the upper surfaces of rafters 16. The ridge members are positioned at the up-slope ends of the rafters, and run the length of the building parallel to the eaves, typically above the central portion of the building. The ridge members provide lateral support to the skeletal structure of the building between respective ones of rafters 16, typically at an internal portion of the building, away from the building side walls in the illustrated embodiments. A given ridge member extends between the second ends 16C of the respective ones of the rafters. Where the roof has a single pitch direction, the ridge can be positioned proximate one of the outer walls of the building.

The ridge members and the eave members overlie, extend transverse to, and are attached to, the upper surfaces of the respective rafters 16, and are spaced from each other by distances which generally correspond to the lengths of the respective rafters between ends 16B and 16C.

Intermediate purlins 24 express "Z"-shaped cross-sections. The intermediate purlins overlie, extend transverse to, and are attached to, upper surfaces 16A of the respective rafters. Purlins 24 are spaced from each other along the lengths of the rafters. The purlins extend parallel to each other and parallel to any ridges and eaves and, overall, span the length of the bay, whereby the purlins are displaced from each other and from any ridges and eaves along the spaces between the respective eave and the ridge.

Figure 2:
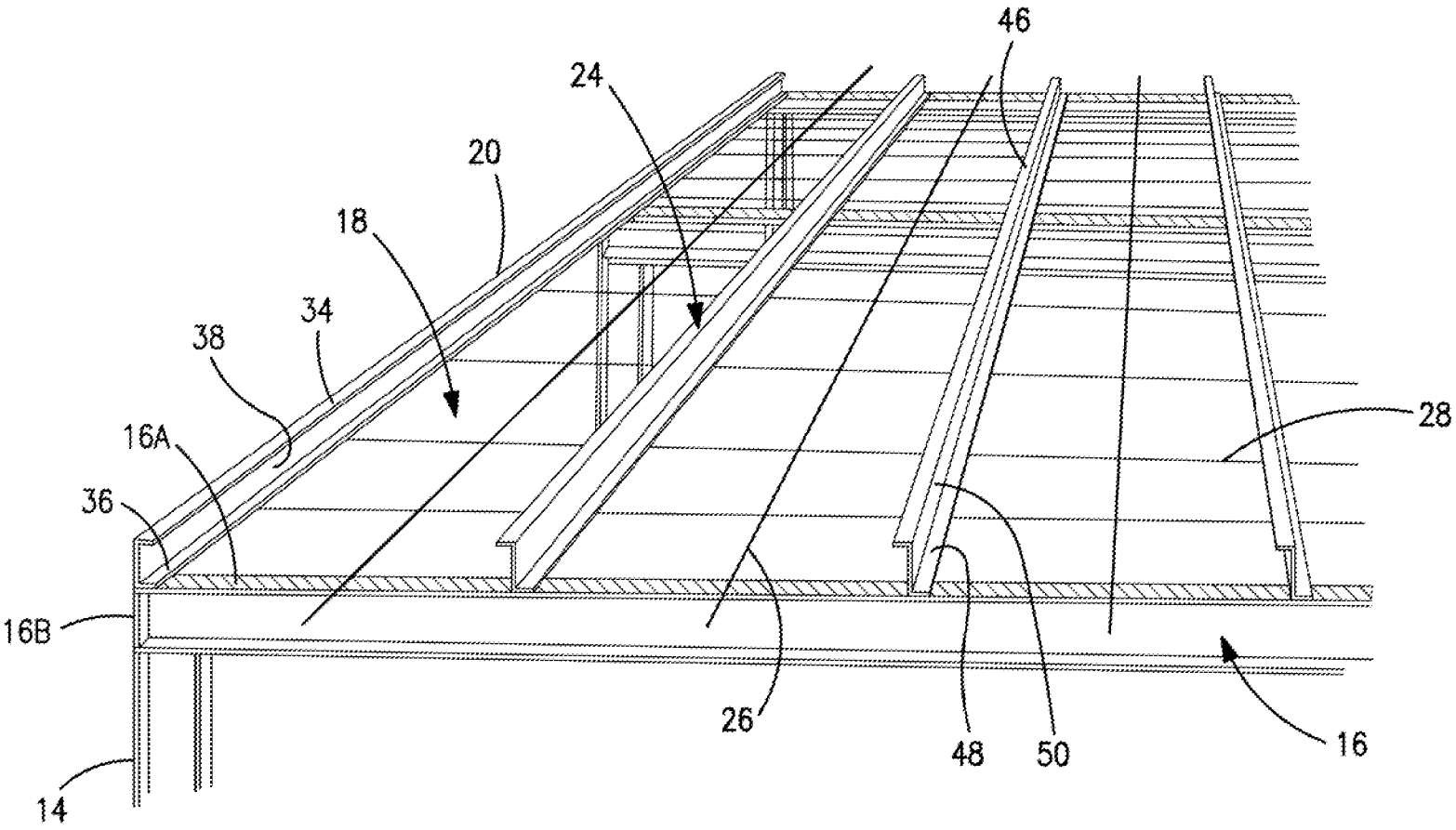
FIG. 2 is a perspective view, from above the roof, of part of a bay of a metal building, showing columns, rafters, purlins, an eave, and a grid-work of crossing bands.

As shown in FIG. 2, a fall protection support system includes a supporting grid-work formed by crossing elongate steel bands, including longitudinal support bands 26 and lateral support bands 28. Support bands 26, 28 of the grid-work are supported by various ones of the building structural members, as described herein, and the collective grid-work generally defines an imaginary plane, extending into the sheet of the drawing illustrated in FIG. 4. Such imaginary plane extends parallel to a set of imaginary straight lines, spaced from each other and extending between the lower surfaces of the eaves 20, the ridge 22, and intermediate purlins 24, and further extending parallel to imaginary straight lines which connect the upper surfaces of the rafters.

Figure 3:
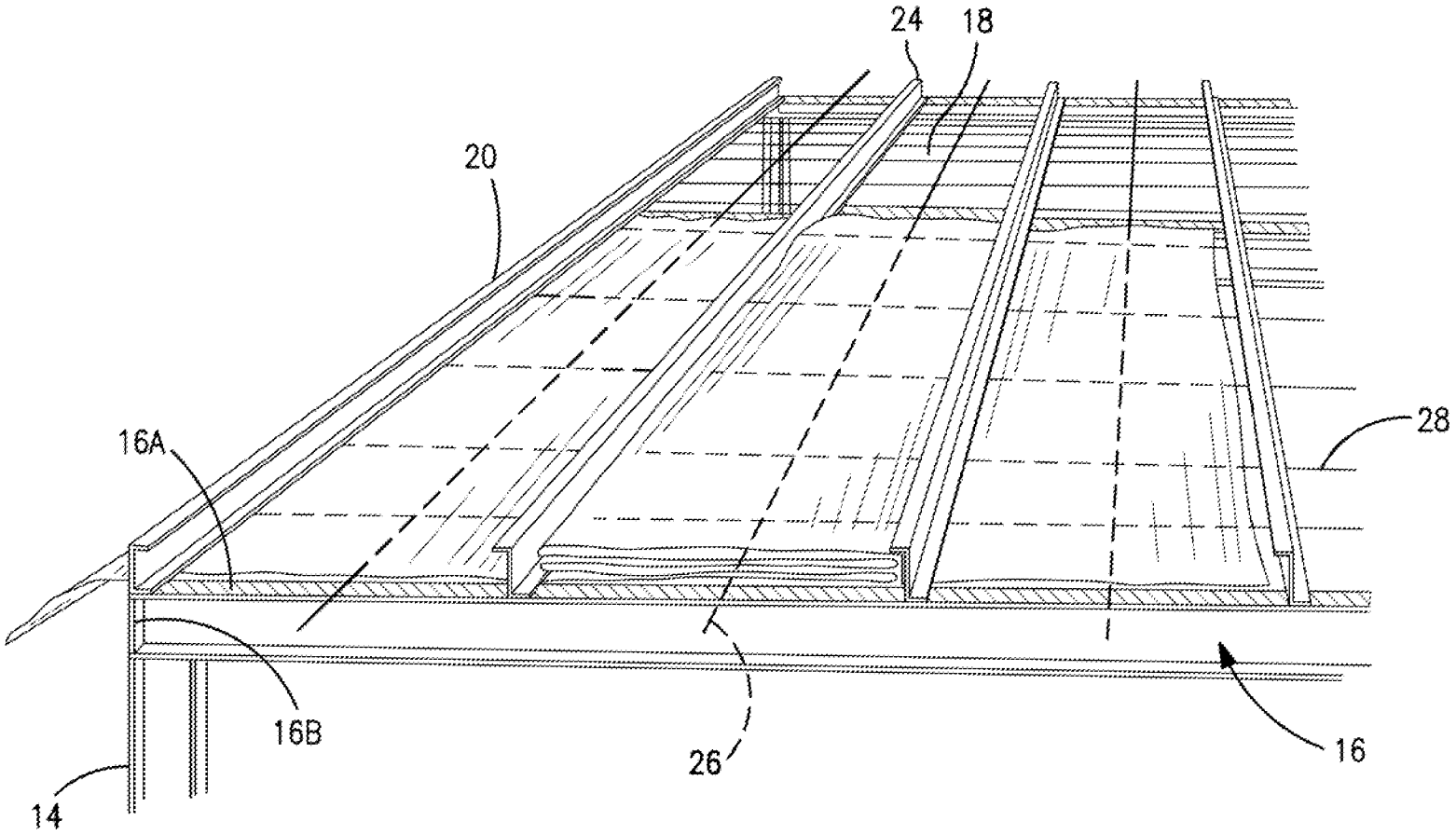
FIG. 3 is a perspective view as in FIG. 2 showing a suspension fabric partially extended over the band grid-work and under the eave and under the purlins, in a single bay.

Support bands 26, 28 support a high strength fabric 32, the fabric being shown partially unfolded in FIG. 3 and, in FIG. 4, the fabric is suggested by the dashed line under the eave, ridge, and intermediate purlins, and above longitudinal bands 26, bands 26 being shown in FIG. 4 in end view. Fabric 32 in the illustrated embodiments also serves as a vapor barrier for the insulation system which is ultimately installed at the roof of the building.

Starting with the structural skeleton of the building as illustrated in FIG. 1, a fall protection system may be installed generally as follows. Longitudinal metal bands 26 are extended from the upper surface of a first one of the rafters to the upper surface of a second one of the rafters at angles which are typically, but not necessarily, perpendicular to the respective rafters. The number of longitudinal bands 26 depends to some degree on the distance between the respective ones of the intermediate purlins 24. Typically, only a single longitudinal band 26 is used between each pair of next-adjacent purlins 24. However, in certain systems, two or more longitudinal bands may be used where such additional band use may be cost-effective and/or when use of such additional band may be needed in order to satisfy the respective governmental standard. Of course, the greater the number of bands used, the greater the cost of the band system. Accordingly, the user is motivated to have the system engineered so as to use as few of such longitudinal bands as possible while meeting the required safety standards.

A length of a given longitudinal band 26 extends across a given bay and is extended across the upper surface of each rafter overlain by the respective band, and is attached to the upper surfaces, or other surfaces, of the respective rafters. Where the longitudinal band 26 extends across multiple bays, the longitudinal band is secured, for restrained longitudinal movement, to the upper surfaces of those rafters which are most remote from one another. Optionally, but not necessarily, the longitudinal band may be secured to one or more intermediate rafters.

Longitudinal bands 26 are fastened to the rafters, rake channels, or rake angle(s) (not shown) which correspond with the end portions of the bands, by conventional attachment means such as by self-drilling screws. Longitudinal bands 26 are pulled tight between the rafters so as to, in part, and at this stage of installation, begin to define the aforementioned band grid, and the imaginary plane of support provided by the band grid, immediately under the intermediate purlins. Band attachment tools, known in the art, may be used in attaching the bands, either temporarily or permanently, to the rafters or rake channels, thus to instill a suitable, conventionally known, level of tension in bands 26 as the bands are being installed.

Each eave has a top flange 34, a bottom flange 36, and an upstanding web 38 extending between the top and bottom flanges, and connecting the top flange to the bottom flange. The top and bottom flanges are arranged such that the profile of the eave defines a generally "C"-shaped structure, perhaps best seen in FIG. 5.

While the eave profiles shown define generally perpendicular turns between the flanges 34 and 36, and upstanding web 38, actual eave profiles typically define a modest acute angle (not shown) between the bottom flange and the upstanding web and a corresponding modest obtuse angle (not shown) between the top flange and the upstanding web. Such acute and obtuse angles adapt the eave to the specific slope of the roof for which the eaves are designed, while providing that the upstanding web conforms to the vertical orientation of the respective side wall of the building.

Correspondingly, each ridge has a top flange 40, a bottom flange 42, and an upstanding web 44 extending between the top and bottom flanges, and connecting the top flange to the bottom flange. The top and bottom flanges are arranged such that the profile of the ridge defines a "Z"-shaped structure, as illustrated in FIG. 4.

Similarly, each intermediate purlin has a top flange 46, a bottom flange 48, and an upstanding web 50 extending between the top and bottom flanges, and connecting the top flange to the bottom flange. The top and bottom flanges are arranged such that the profile of the respective purlin defines a "Z"-shaped structure, illustrated in FIGS. 4 and 6.

Lateral bands 28 are installed after the longitudinal bands 26 are in place. Lateral bands 28 extend transverse to, typically perpendicular to, the longitudinal bands. Lateral bands 28 generally underlie and support longitudinal bands 26. Lateral bands 28 may be first attached to the respective ridge 22. Bands 28 may be attached to any suitable surface of the ridge which enables the band to pass, from the location of attachment, under and in tensioned contact with, the bottom flange of the ridge. For example, a lateral band can be attached to the bottom surface of the bottom flange of the ridge, with intervening fabric 32, and extend from there toward the eave.

As an alternative, one end of a given lateral band can extend up alongside, and be fastened to, the surface of the upstanding ridge web 44 which faces away from the eave on the respective slope of the roof. The band passes downwardly alongside web 44, and turns about the edge of the bottom flange of the ridge which faces away from the respective eave, and then passes under, and in general contact with, the bottom surface of the bottom flange, again with intervening fabric, and extends from there toward the eave.

As a still further example of attachment of a lateral band to the ridge, the band can be attached to the top surface of the top flange, turn about the upper edge of the top flange which is away from the respective eave, extend from there down toward the bottom ridge flange, turn about the edge of the bottom flange and pass alongside, and in general contact with, the bottom surface of the bottom flange, and extend from there toward the eave, again with the fabric between the band and the ridge.

The lateral bands are extended, from the bottom surface of the bottom flange of the ridge toward the respective eave, passing under the longitudinal bands, and pulled tight to minimize sag in both the lateral bands and the respective overlying longitudinal bands. The so-tightened lateral bands are in general contact, again with intervening fabric, with the bottom surface of the bottom flange of the respective eave. With the so-tightened lateral bands in contact with the bottom surface of the bottom flange of the respective eave, the lateral bands are fastened to the eave so as to maintain the tension in the lateral bands, thus to lift the lateral bands toward the bottom flanges of the overlying intermediate purlins.

The number of lateral bands 28 to be used between a respective pair of next-adjacent rafters, and the spacing between the lateral bands, varies with the distance between the rafters. Typically, the lateral bands are 36 inches to 40 inches apart, optionally up to 48 inches apart in some cases.

Traditional banding stock used for bands 26 and 28 is a hot-dip zinc/aluminum alloy-coated Grade 80 structural steel, 0.023 inch thick, having longitudinal tensile yield strength of at least 93 ksi, such Grade 80 banding sometimes being referred to in the industry as "full hard". Such steel banding is typically about 1 inch wide and continuous length. Such traditional "full hard" steel banding is available from Steelscape, A BlueScope Steel Company, Kalama, Wash. as ZINCALUME® Steel Grade 80 (Class 1).

Representative properties of such Grade 80 (Class 1) banding, 0.023 inch thick, from Steelscape are as follows:

Yield strength—100.1 ksi average, 93.9-104.1 ksi range

Tensile strength—102.2 ksi average, 95.4-105.3 ksi range

Elongation in 2 inch sample—10% average, 9.6-10.3% range

Hardness, Rockwell B Scale—93.4 average, 92-95 range

"Ksi" means "thousands of pounds per square inch".

Figure 5:
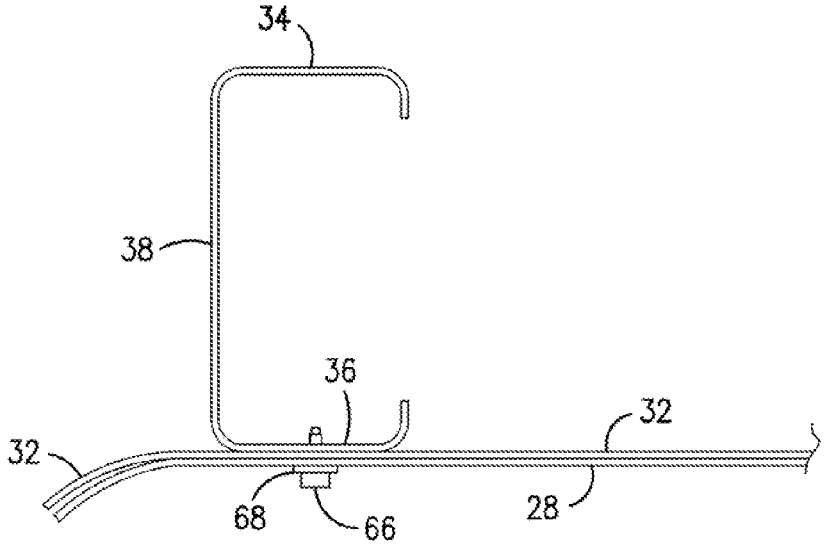
FIG. 5 is an edge view showing a lateral band fastened, attached, to the bottom flange of the eave.
Figure 6:
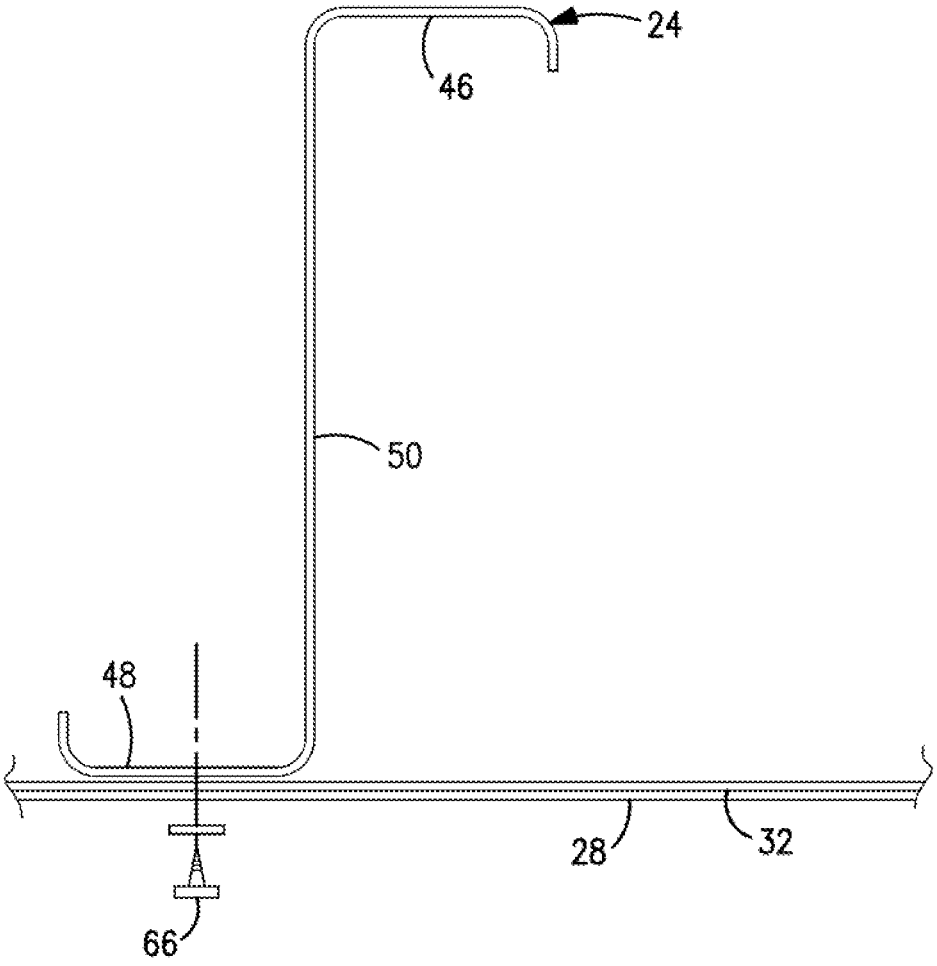
FIG. 6 is a cross-section of an intermediate purlin, and a Tek screw, with washer, positioned to extend the screw through the fabric and into the purlin bottom flange.

FIG. 5 shows the attachment of a lateral band to an eave 20 using a standard Tek screw. FIG. 6 shows the impending attachment of the lateral band to an intermediate purlin using a standard Tek screw.

Figure 7:
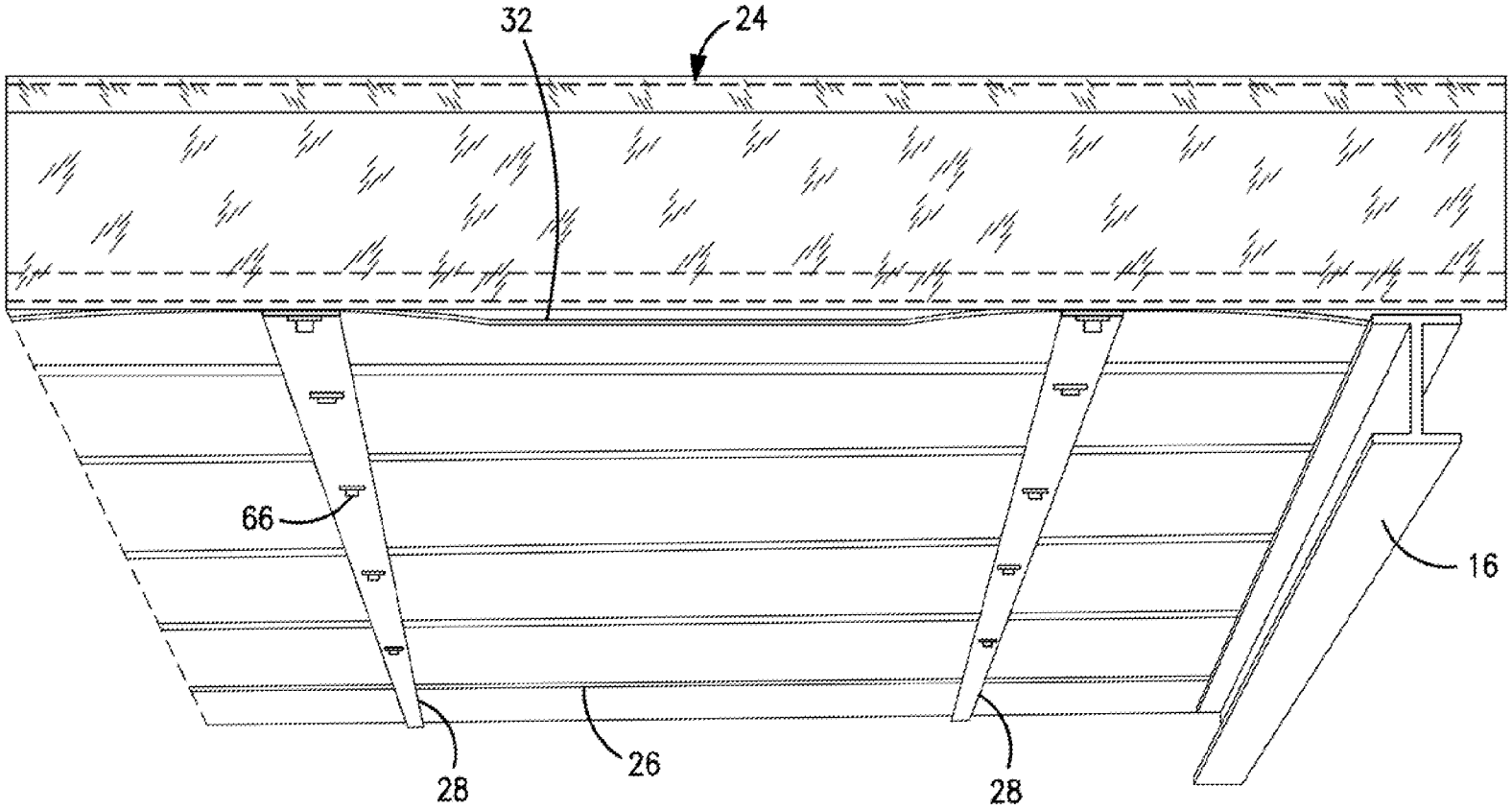
FIG. 7 is a perspective view from below a fall protection system, showing a purlin mounted on one of the rafters, also showing the lateral bands and the longitudinal bands collectively supporting the suspension fabric across a bay.

FIG. 7 illustrates that longitudinal bands 26 are supported by lateral bands 28, in that the tightened lateral bands underlie the longitudinal bands. Referring again to FIGS. 2 and 3, it is seen again that the longitudinal bands are secured against longitudinal movement only at rafters 16.

Certain fabrics are known in the art for use as suspension fabrics in roof insulation systems, and such fabrics may also be acceptable in fall protection systems, provided for example that the bands used in the band grid-work are sufficiently close together. An exemplary fabric for use with the band grid-work disclosed herein is available as Type 1070 Vapor Retarder fabric from Intertape Polymer Group, Bradenton, Fla. The Type 1070 fabric is a woven HDPE scrim having the following characteristics as specified by the fabric supplier:

Nominal thickness—9 mils (0.23 mm)

Nominal weight—4.3 oz/yd$^2$ (149 g/m$^2$)

Grab Tensile—Warp 136 lb (605 N)/Weft 126 lb (559 N)

Strip Tensile—Warp 100 lb/in (877)/Weft 90 lb/in (799)

Tongue Tear—Warp 50 lb (222 N)/Weft 45 lb (200 N)

Mullen Burst—245 psi (1690 kPa)

Moisture vapor transmission—0.02 perms.

A typical bay 18 is about 25 feet wide, between pairs of next-adjacent rafters. Within a given bay, lateral bands 28 extend parallel to each other, parallel to the respective rafters which define the bay, and are generally spaced apart by about 36 inches to 40 inches, but no more than 48 inches. Thus, a desired spacing between lateral bands 28 is 36-40 inches; but up to 48 inches is accepted where the increase from 40 inches e.g. up to 48 inches can reduce the number of bands.

A leading edge of fabric 32 can be placed inside the eave. A leading edge of the fabric enters the eave above bottom flange 36, passes across the top of the bottom flange to web 38, passes along the inside surface of web 38 and up to upper flange 34 and thence toward the ridge, to the eave opening which faces the ridge. By traversing such path inside the cavity defined inside the eave, the fabric can substantially encase the edge of any insulation which is to be installed on top of the fabric in the space between the eave and the next-adjacent purlin.

In the alternative, the edge of the fabric, at the eave, can be trapped between the lateral banding and the lower surface of the bottom flange of the eave as suggested in FIGS. 3 and 5.

If/When a falling/dropping impact force arrives on the suspension fabric, the force received by the suspension fabric has a first directional force component and a second velocity/shock/suddenness component. The force component of the impact is resisted by, absorbed by, the deflection characteristics of the materials in the fall protection system. The velocity/shock/suddenness component of the impact addresses the rate at which the respective materials can deflect as the force of the impact is applied to the respective building elements.

Where a given lateral band 28 is one of the closest lateral bands to the point where the impact force is received, a first portion of that force, which is received at the fall protection system, is transferred, as first tensile forces, into the respective lateral band and is absorbed, dissipated, at least in part, by tensile elongation of the respective lateral band.

A second portion of that received force is transferred, by the lateral band to the next-adjacent purlins which are closest to the location of the impact.

A third portion of that force is received into the respective longitudinal band, or bands, and is absorbed, dissipated, at least in part, by tensile elongation of the respective longitudinal band or bands.

A fourth portion of that received force is received by the respective longitudinal band or bands, and transferred by the longitudinal bands, to the respective rafters 16.

A fifth portion of that received force is distributed about the respective affected area of the suspension fabric. While choosing to not be bound by theory, the inventor herein contemplates that the fabric absorbs both a portion of the directional component of the force of the impact and a velocity/shock/suddenness component of the force of the impact.

Turning again to the responses of the bands, the tensile forces so imposed on the longitudinal bands and the respective lateral band or bands are distributed along the full lengths of the respective longitudinal bands and along that portion of the respective lateral band or bands which is/are between the two purlins which are next adjacent the location on the fall protection system where the impact of the drop is received. Thus, the elongation properties of both the longitudinal bands and the lateral bands are utilized in transferring portions of the impact force to the roof structural elements, namely one or more intermediate purlins, and optionally to ridges or eaves, and to the rafters or rake channel(s) or rake angle(s).

FIG. 7 further shows, in its typical configuration of the fall protection system of the invention, that lateral bands 28 can, and commonly are, attached to each purlin in a conventional manner, namely by screwing a Tek screw 66, with accompanying washer, through a hole in the lateral band, thence through the suspension fabric, and thence through the lower flange of the respective purlin. The suspension fabric is thus trapped between the lower flange of the purlin and the respective washer/screw combination, which tightly clamps the suspension fabric to the lower surface of the lower flange of the purlin.

Method of Installing Fall Protection System

Installation of a fall protection system may begin after the columns, rafters, ridges, eaves, and intermediate purlins are in place about at least a given bay. Typically, installation of the fall protection system begins after erection/emplacement of all of the columns, rafters, ridges, eaves, and purlins.

Installation of the fall protection system begins by installing longitudinal bands 26. A given longitudinal band is installed by unwinding band material from a roll and extending the band material over the tops of the respective rafters and across a given bay or bays. At least one longitudinal band is extended, between each next-adjacent pair of purlins to at least the next rafter, and is cut to length. The longitudinal bands are manually stretched tight with hand tools, and the so-tightened bands are fastened to the respective rafters with Tek screws. As illustrated in the drawings, the longitudinal bands typically extend perpendicular to the rafters, rake channel(s), or rake angle(s). The so-partially-installed, tightened, longitudinal bands extend from rafter to rafter at generally the height of the tops of the rafters, but some nominal amount of sag of the longitudinal bands exists between the rafters at this stage of installation.

Typically, the purlins are spaced no more than 5 feet apart. A single band may be installed between each pair of next-adjacent purlins so long as the purlin spacing is no more than the typical maximum of 5 feet. Where the purlin spacing approaches, or exceeds, the typical 5-feet maximum, an additional longitudinal band 26 may be used in one or more of the spaces between the purlins.

Once the longitudinal bands 26 have been emplaced and tightened, banding for lateral bands 28 is unrolled under the longitudinal bands, and one end of the banding is secured to the respective ridge or purlin, or to an opposing eave. The lateral banding material is extended to the eave of the respective bay and then tightened sufficiently to raise both the lateral band and the overlying longitudinal bands into close proximity with the intermediate purlins. This process is repeated along the width of the bay, e.g. between the rafters, until the desired number of lateral bands has been emplaced across the width of the bay.

With the band grid system thus temporarily in place, a zigzag-folded roll of the suspension fabric is elevated to the height of the rafters, typically adjacent a rafter at an end of the building or bay. The fabric is then unrolled on top of the band grid in one of the spaces between next-adjacent ones of the purlins such that one end of the fabric faces the eave and the opposing end of the fabric faces the ridge. The ends of the fabric are then pulled, individually, toward the eave and the ridge, working the leading ends of the fabric under the intervening intermediate purlins and above the band grid. The initial phase of the process of so-extending the fabric is illustrated in FIG. 3. In cases where the building structure includes flange braces that connect at least some of the rafters to at least some of the purlins, such braces may interfere with this process of extending the suspension fabric underneath purlins to which the braces are attached. Accordingly, in order for the suspension fabric to be fully laid out across the bay, the upper ends of the braces may need to be detached from their respective purlins and bent downwardly to provide an unobstructed space for the suspension fabric to be stretched across. This is shown below in connection with FIGS. 13A, 13B, and 13C.

With the fabric having been generally extended the full length and width of the bay over which the fabric is to be suspended, namely over the band grid and under the intermediate purlins, the lateral bands are then attached to the intermediate purlins, one self-drilling Tek screw through each lateral band and the fabric, at each purlin, typically beginning at the ridge and working toward the eave. As a such Tek screw/washer is driven tight against the bottom surface of the fabric, the fabric is correspondingly driven tight against the bottom surface of the lower flange of the purlin. The fabric is thus tightly trapped between the washer and the lower flange of the purlin. Screws 66 are driven through each lateral band 28 at each purlin, fastening the lateral bands directly to the purlins as illustrated in FIG. 7.

Once the attachments to the intermediate purlins have been completed, the temporary attachments of the bands to the eave are released, and the lateral bands are permanently attached to the eave, e.g. using screws 66 driven through the lateral bands, e.g. as illustrated in FIG. 5.

Sides of the fabric are then cut around the purlins at each rafter, as known in the art, and edges of the fabric are secured to the top surfaces of the rafters such as by adhesive, also as known in the art.

With both the longitudinal and lateral bands so secured to the roof structure, and with the fabric so secured to the ridge and eave by the lateral bands and secured to the rafters by e.g. adhesive, installation of the fall protection system of the invention is thus complete and ready to protect workers who subsequently install other elements of the building while working at the roof elevation; such elements as the roof insulation and the roof panels.

Suspension fabric 32, which in the preferred embodiment is or includes a vapor barrier material, is trimmed to size before installation. Specific trimming of the suspension fabric 32 in the form of notches may also be performed before or during installation at locations where purlins contact the upper surfaces of rafters. A notch in the fabric at such a location allows the edge of the fabric to more fully cover the top surface of the rafter immediately adjacent the point of contact with the purlin, while also allowing the fabric to extend longitudinally across substantially the entire accessible length (between adjacent rafters) of the bottom flange of the purlin. This is shown and described below in connection with FIG. 17A. The suspension fabric is installed one bay 18 at a time and, in the case of large buildings or buildings with high gables, fabric 32 for each half of the bay may be divided at ridge 22 and may be installed separately.

The suspension fabric has been cut, prior to installation, to a size having a dimension a few inches longer, at each side and each end, than the dimensions of the bay to be overlaid, and is Z-folded for easy spreading above the band grid. For this purpose a zigzag type fold, as shown in FIG. 3, is easiest to work with, although other rolling or folding arrangements can also be used and are within the scope of the invention.

The fall protection systems discussed herein can be designed to be of sufficient strength to catch and support a man's weight, generally between 250 and 400 pounds. The system is tested by dropping a 400 lb. weight, with the center of gravity of the weight, before the weight is dropped, being 42 inches above a worker's walking height, thus 42 inches plus the height of the purlins, namely about 50.5 inches above the fabric. To pass the test, the system must effectively stop the falling weight at any point in the bay which is so protected. In one test specified by OSHA, 400 lb. of washed gravel or sand is placed into a reinforced bag that can tolerate being dropped repeatedly. The test bag is 30 inches in diameter. The 400 pound bag is hoisted above the fall protection system to a height of 42 inches above the plane of the intermediate purlins, measuring from the center of the so-filled bag. A cord supporting the weight of the bag is then released, allowing the weight to free fall in one concentrated load. The weight can be dropped onto any part of the fall protection system to test different areas.

Figure 8:
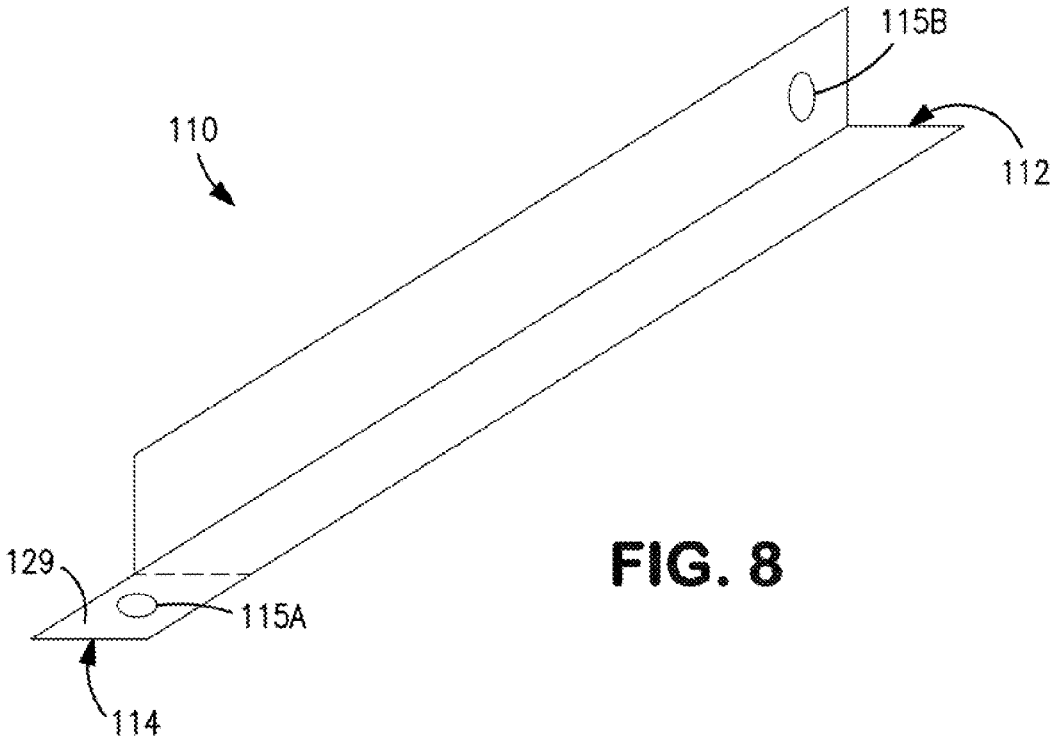
FIG. 8 is a perspective view of a flange brace.

Having generally described exemplary building and roof structures and passive fall protection systems and related systems and components, we now turn to FIG. 8 and following for a discussion of how brace covers can be used advantageously in such structures and systems which also incorporate flange braces.

Flange braces can come in a variety of sizes and shapes, but a typical flange brace 110 is shown schematically in FIG. 8. Such a brace may be made by bending or folding a flat piece of metal or other suitable material longitudinally along its length by an angle of nominally 90 degrees, or another suitable angle, or by welding or otherwise joining two flat pieces of metal to form a similarly angled structure. Brace 110 has a first end 112 and a second end 114, which may also be referred to as an upper end and a lower end, respectively. A portion of one of the angled sides at the lower end 114 can be removed as shown in the figure to define a flat end portion which is able to bend relatively more freely, e.g. as about the dashed line shown in FIG. 8. Holes can also be provided in the ends as shown to allow the brace to be securely fastened, e.g. with a bolt and nut, to different elements of the building structure, such as a rafter 16 at lower end 114 of the brace and a purlin 24 at upper end 112 of the brace. In this regard, it is useful in many cases to provide at least one hole 115A in a first angled side at one end, and at least one other hole 115B in a second angled side (which may be perpendicular to the first angled side) at upper end 112. By securely fastening the ends of brace 110 to neighboring building elements, at appropriate positions on those elements, the brace can enhance the mechanical integrity of the structure.

A given flange brace may be characterized or described in terms of its length, its cross-sectional shape, and by any other relevant features and dimensions. Braces of the type shown in FIG. 8, sometimes referred to as angle braces, are known for use in metal building construction. Such braces are made of steel, aluminum, or other suitable metals, and are available in standard sizes, e.g., 1.5×1.5 (1.5 inches by 1.5 inches), or 2×2 (2 inches by 2 inches) or 2.5×2.5 (2.5 inches by 2.5 inches). Such dimensions refer to the width of each of the angled sides that make up the angle brace, or, stated differently, to the length of each leg in the L-shaped cross section of the brace. Thus, for example, in one standard size, each leg of the L-shaped cross section is 1.5 inches long, and in another standard size, each such leg is 2 inches long, and so forth. The wall thicknesses of these legs, or of the angled sides, are known in the art. Such braces are available in a variety of lengths. The foregoing dimensions and features are merely exemplary, and should not be used to unduly limit, the sizes or shapes of braces which can be used in the disclosed embodiments.

Alternative brace designs that may be suitable for a given building structure, depending on the size of the building and the elements used in the building structure, include braces which can be made by providing a length of hollow metal tubing, the length equal to the length of the desired brace, each of the two ends of the tube optionally, but typically, having been flattened, e.g. by hammering or pressing the tube flat at the ends, including rotating the tube by nominally 90 degrees between effecting such flattening activities such that the flattened ends are nominally oriented perpendicular to each other. As with the embodiment illustrated in FIG. 8, holes 115A, 115B can be drilled into such ends to allow for attachment by nut/bolt combinations or other suitable attachment mechanisms. The cross-sectional shape of a brace made in this way is, over substantially all of its length except for the e.g. two flattened ends, the same as the cross-sectional shape of the original metal tubing, which may be circular, square, rectangular, or other shapes as desired. With regard to angle braces and other braces that may have an L-shaped cross section, the term "L-shaped" should be interpreted broadly to encompass at least embodiments in which the two legs of the L-shape are of equal length, as well as embodiments in which the two legs of the L-shape are of unequal length; and embodiments in which the two legs of the L-shape are orthogonal (oriented at 90 degrees) to each other, as well as embodiments in which the two legs of the L-shape are not orthogonal.

Figure 9:
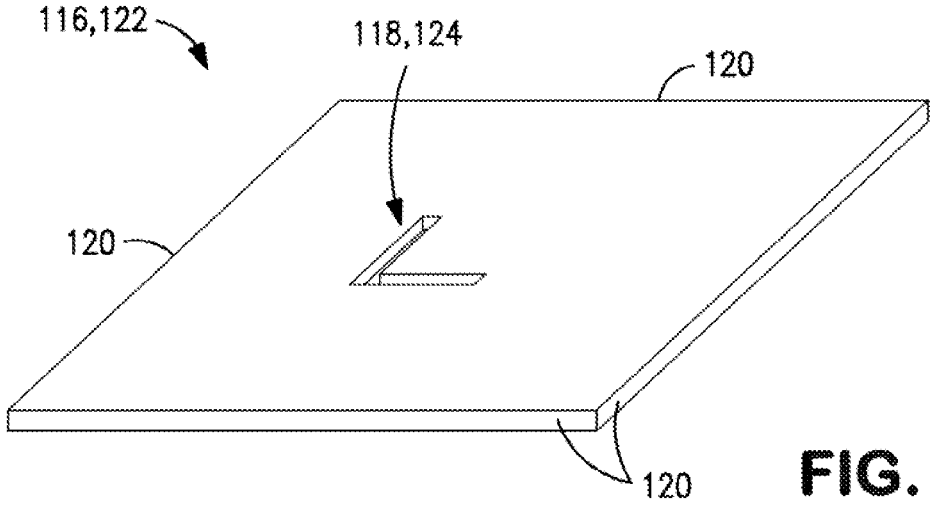
FIG. 9 is a perspective view of an apertured plate which may serve as a brace cover.

FIG. 9 shows a plate 116 that may be adapted for use with the brace of FIG. 8. In rudimentary embodiments, the plate 116 may, by itself and with no additional elements, serve as a brace cover 122. In other cases, other elements such as a fabric piece are attached to the plate to form a more functional and/or a more aesthetically pleasant-appearing brace cover, as discussed further below. In either case, a brace cover may be provided for each and every brace in the building structure, for example for a brace which extends through the suspension fabric, i.e., for each brace in the building structure for which the opposed ends of the brace lie on opposite sides of the suspension fabric, or optionally a brace cover may be provided for only some such braces. The brace cover may serve one or more basic functions, for example, to conceal the opening in the suspension fabric, to facilitate sealing around the brace, e.g. in the vicinity of the fabric opening, and/or to provide support for the suspension fabric, e.g. near the fabric opening.

A plate aperture 118 extends through plate 116. Aperture 118 is sized so as to be able to receive brace 110. Aperture 118 is sometimes herein referred to as a cover opening 124, namely where there are no other elements which form part of the cover opening besides plate 116. That is, plate aperture 118 has an appropriate size and shape so that an end of brace 110 can pass through aperture 118. E.g. upper end 112 of the brace can be made to pass through aperture 118 by holding the brace stationary and moving the plate, or by holding the plate stationary and moving the brace, or by moving both the brace and the plate. The size and shape of plate aperture 118 is such that e.g. end 112 of brace 110 can pass through the aperture at an oblique, namely a non-perpendicular, angle corresponding to an orientation angle the brace makes with the plate in the installed system. Preferably, the aperture is not so large that a large gap remains between brace 110, as installed, and the rigid/metal or rigid/plastic portion of plate 116. Stated differently, the plate aperture preferably has a shape which is similar to a cross-sectional shape of the brace, e.g., a transverse cross-section of the brace, or a cross-section of the brace in a reference plane parallel to the aperture, as described further below. For example, in the case of FIGS. 8 and 9, brace 110 has an L-shaped cross section, and aperture 118 is also L-shaped, though larger than the cross-section of the L-shape of brace 110 to allow the brace to slide through plate aperture 118 with only minimal, if any, resistance.

In alternative embodiments, plate aperture 118 can be made rectangular while the cross-section of brace 110 remains L-shaped, the rectangular aperture being sized so that two edges of the rectangular aperture are close to or touching the outer surfaces of the two angled walls of the brace. An example of this is shown below in FIG. 20B. Generally speaking, the plate aperture can have any desired shape, e.g. square, rectangular, another polygonal shape (including but not limited to an L-shape), or circular, oval, elliptical, or otherwise curved. Preferably, however, the plate aperture is made so that the flange brace 110 fits within the aperture as installed in the building system, with only minimalist spacing between the sides of the aperture and the surfaces of the brace. Typically, the longitudinal axis of flange brace 110 is obliquely oriented or tilted relative to a reference plane defined by the plate aperture and the plate 116 or cover 122. Thus, for example, if the flange brace is made from a round (circular) tube which has been flattened on both ends, plate aperture 118 is desirably oval or elliptical, the eccentricity of the oval being determined by the angle at which the flange brace is designed to be oriented relative to the plane of brace cover 122 and plate 116. Alternatively, the plate aperture in such case may have a rectangular shape, the rectangular shape corresponding to approximately the oval cross-sectional shape of the round tube as the installed tube extends through the aperture, such that the brace still fits relatively snugly within the rectangular aperture.

Plate 116 is typically made of metal, but other suitable materials, such as hard plastics, may also be used. However, as suggested by the term "plate", the material used for the plate preferably has a sufficient thickness so that the plate 116 has a substantial mechanical rigidity or stiffness. The desired rigidity is preferably enough so that, when the plate, and thus the brace cover, is installed, e.g. attached to a purlin on one side of the brace, the edge of the plate on the other side of the brace does not droop or sag, but rather provides enough support to the suspension fabric above the plate to hold that portion of the fabric in a visually consistent orientation relative to the surrounding portions of the fabric. In an exemplary embodiment, plate 116 is made of a single piece of 0.015 inch thick steel, and has a plate perimeter 120 which is nominally square, each side of the square being 12 inches long. In this embodiment, aperture 118 is L-shaped, each leg of the aperture being 3 inches long, and aperture 118 is located at or near the center of the square-shaped plate. Metals other than steel, such as aluminum, as well as layered/laminated materials, can also be used in fabricating plate 116. In cases where plate 116 is made of metal, a typical thickness e.g. from about 0.010 inch to about 0.050 inch, but this range should not be construed in an unduly limiting manner so long as the plate serves in the above-described capacity.

The particular plate embodiment mentioned above uses a 12 inch square, e.g. each side 12 inches long, plate perimeter. Other perimeter sizes and shapes, including rectangular, polygonal, circular, or elliptical, may also be used. Whatever the shape, the overall length and/or width of the plate 116 is typically at least about 8 inches, or at least about 10 inches, or at least about 12 inches, e.g. in order to fully conceal, and/or seal around, the opening in the suspension fabric. Further in this regard, plate perimeter 120 is also preferably sized so that, when the brace cover is installed, the plate perimeter, as well as the cover perimeter, encircles the opening in that suspension fabric which the brace extends through.

Plate 116 of FIG. 9 has a single piece construction, e.g. plate 116 is made of a single unitary piece of metal or other suitable material. In alternative embodiments discussed further below, plate 116 may be made of multiple plate pieces such as two plate pieces which overlap and attach to each other to provide a rigid combination of the plate pieces, the combination having an aperture which is partially defined by a first such plate piece, and partially defined by a second such plate piece.

Figure 10:
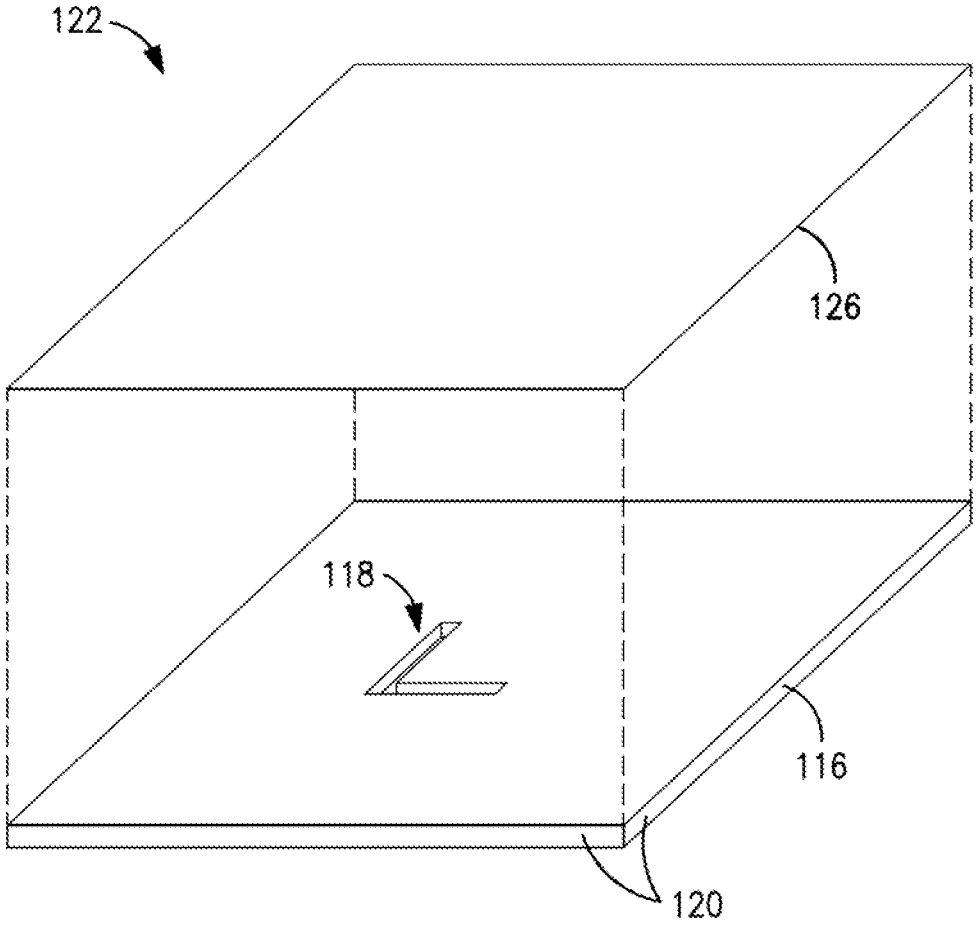
FIG. 10 is a perspective exploded view of a second embodiment of a brace cover.

Turning to FIG. 10, an alternative brace cover 122 is shown in an exploded view to more clearly distinguish its two main constituent components. Brace cover 122, shown in FIG. 10 includes, or may consist essentially of or consist of, an apertured plate 116 as illustrated above and a piece of fabric or other thin-section sheet material 126 which is laminated to or otherwise attached to one major surface of plate 116, e.g. with a suitable adhesive layer or other suitable bonding material disposed between the fabric and the plate. The lamination of fabric 126 may be performed by workers at the building construction worksite, or may be performed in a factory or a distribution facility before the brace covers are shipped to the construction site. The entire brace cover, including apertured plate 116 and laminated fabric piece 126, may be made by workers using materials and tools which are available at the building construction site, e.g., by making use of excess sheet metal and excess suspension fabric which may be present at the construction site. Plate 116 of FIG. 10 may be the same as, or similar to, the plate 116 described above in connection with FIG. 9, and needs no further explanation here.

Fabric piece 126 is preferably made of the same or similar material as the suspension fabric 32 against which brace cover 122 is intended to be ultimately placed or installed. In this regard, cover 122 is installed in the building structure such that the major surface of plate 116 which has no fabric applied faces generally upwardly, facing the suspension fabric and the respective purlin, and the major surface of the plate which does have the fabric applied, faces generally downwardly, and is typically exposed and visible to occupants of the building, against the background of the surrounding suspension fabric. By ensuring that the surface of fabric piece 126 which faces toward the occupants of the building has an outer appearance, e.g., color and texture, which is the same as or similar to the appearance of the suspension fabric, the brace covers can visually "blend in" and become inconspicuous substantially un-noticeable, to building occupants who look upward toward the ceiling/roof. In this manner, the brace cover conceals the opening in the suspension fabric, and may conceal any patch tape or other products which may have been applied at the fabric opening.

Figure 11:
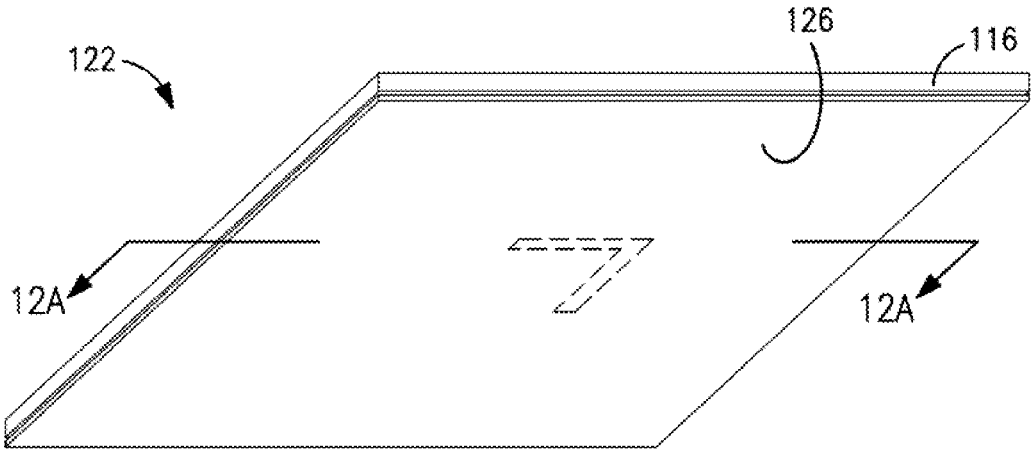
FIG. 11 is a perspective view from below an inverted brace cover like that of FIG. 10.

A view of brace cover 122 from below is illustrated schematically in FIG. 11. The brace cover of that figure may be the same as or similar to the brace cover of FIG. 10, except that the fabric piece of the brace cover is shown in its laminated state in FIG. 11. Brace cover 122, as shown in FIG. 11, may also be considered as being in an "initial state" meaning that the fabric piece 126 extends flat, and continuously, across plate aperture 118, with no perforations or cuts in the fabric piece 126 at or in the vicinity of the plate aperture. Reference in this regard is also made to the cross-sectional view of FIG. 12A, taken along the cut line 12A-12A in FIG. 11. The fabric piece 126 is preferably attached to plate 116 by an adhesive layer or the like such that the fabric piece covers at least the plate aperture. In the alternative, the fabric piece can be attached by any of a variety of mechanical fasteners such as screws, rivets, nails, and the like.

In many (but not all) cases, the fabric piece covers substantially the entire major surface of plate 116 such that the perimeter of fabric piece 126 matches the plate perimeter 120. Regardless of the coverage of the fabric piece over the major surface of plate 116, in at least the region of plate aperture 118, the fabric piece is initially preferably imperforate, i.e., without significant holes or other openings, such that the fabric piece seals the plate aperture. Typically, although not necessarily, the entire fabric piece 126, not merely the portion proximate the plate aperture 118, is continuous and imperforate in the initial state shown in FIGS. 11 and 12A. Fabric piece 126 is made of a material which provides a barrier to air flow, and which also preferably provides at least a minimal level of vapor barrier.

Besides serving a possible aesthetic purpose or function, fabric piece 126 in particular facilitates sealing around the brace by more closely conforming to the outer surfaces of the brace than does aperture 118 in plate 116, after the brace cover is fully and completely installed about the brace. Stated differently, in the installed configuration, there are typically gaps between the brace and the plate, due to portions of the plate aperture being spaced from the surface of the brace. Because the passageway through the fabric piece is made by slitting the fabric piece, typically without any substantial removal of material from the fabric piece, gaps between the brace and fabric piece 126 can be substantially smaller than the gaps between the plate and the brace, due to the conformable, flexible nature of the fabric whereby edges of the fabric readily conform to articles with which the fabric comes into contact. In a final or near final step of installation, a sealant can be applied around the brace, both at the suspension fabric and at the brace cover fabric, to fill such gaps, spaces in order to restore the ability of the suspension fabric and/or the brace cover fabric (as repaired) to act as an effective vapor barrier and/or barrier to air flow.

Figure 12A:
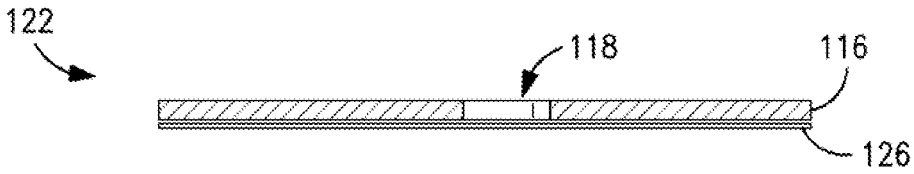
FIG. 12A is a cross-section of the brace cover of FIG. 11 along line 12A-12A.
Figure 12B:
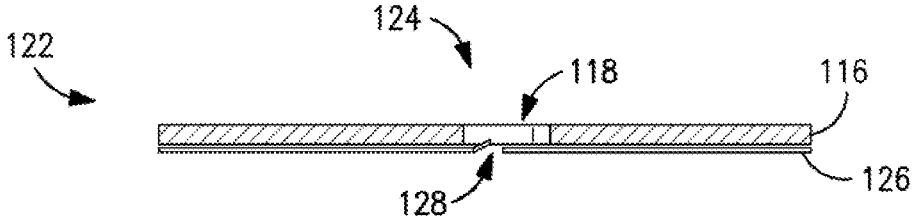
FIG. 12B is a cross-section of the brace cover of FIG. 12A after cutting an opening in the fabric piece.

Before the brace cover can be installed on the brace, the intact, continuous nature of the fabric piece in the vicinity of plate aperture 118 is removed or eliminated by cutting a slit or other opening in the fabric piece in that vicinity. Such cut fabric is illustrated schematically in FIG. 12B, where the same brace cover 122 is shown in the same cross-sectional view as FIG. 12A, except that the cover 122 in FIG. 12B is shown in a later state in which the fabric piece has been cut at a location underlying aperture 118, thereby providing a fabric piece opening 128. The formation of fabric piece opening 128, by underlying aperture 118, creates an opening through the combination of plate 116 and fabric 126, thus through brace cover 122, such opening being referred to herein as a cover opening and labeled 124 in FIG. 12B. In the embodiment shown, cover opening 124 comprises both fabric piece opening 128 and plate aperture 118. For example, air which flows through cover opening 124 flows through both fabric piece opening 128 and plate aperture 118. In an alternative embodiment in which the fabric piece is omitted, cover opening 124 may include only, and may be the same as, plate aperture 118.

Opening 128 is depicted in FIG. 12B as a "simple slit", which means that substantially no fabric material is removed from the original fabric piece in the process of forming opening 128, but instead, portions of the fabric piece 126 separate from each other to form a small opening but otherwise remain connected to the remainder of the original fabric piece 126. The simple slit may be made using a single, straight cut, e.g. using a sharp knife or other suitable cutting implement, or the slit may be made using a more complex cut, e.g. a T-shaped cut in which two flaps are formed in the fabric piece. In alternative embodiments, opening 128 can be made by completely removing a portion of the original fabric piece 126. For example, the fabric piece 126 can be slit in a continuous path to completely remove a portion of the fabric piece from the remaining fabric piece, e.g., by slitting around the entire edge of plate aperture 118 to define and remove a fabric portion having the same shape, in plan view, as plate aperture 118. Compared to a fabric piece opening 128 in which a portion of the original fabric piece 126 is removed, a fabric piece opening 128 which is made using a simple slit, with no substantial removal of the original fabric piece, is advantageous in that the fabric bounding such opening 128 can more closely conform to the outer surfaces of flange brace 110. The closer conforming fabric can help provide a more reliable seal if and when a flowable e.g. tube sealant is applied around brace 110.

Fabric piece 126 has been discussed above as being the same material as suspension fabric 32. In the alternative, fabric piece 126 can be any of a variety of materials. The functional requirements of fabric piece 126 are that fabric piece 126 provide an air barrier, and be readily penetrable over the plate aperture in order to provide a passageway for brace 110, through the fabric piece. Desirably, but not as a limitation, fabric piece 126 also provides a visually pleasing, or at least neutral, appearance.

As long as those minimal limitations are met, fabric piece 126 can be any of a variety of materials. The fabric piece was described above in terms of being made of the same material as the suspension fabric. The fabric piece can also be any film or sheet material, or multiple layers of film or sheet material, which collectively provide the necessary functional performances. Thus there can be mentioned fabrics made of woven or non-woven fiber and/or plastic threads, plastic films, combinations of one or more layers of plastic film, optionally combined and/or laminated with, one or more layers of threaded material. Thread materials may be any of the natural fibers, any of the polymeric fibers. As the plastic films, there can be mentioned as examples, but without limitation, various of the olefin or olefin-based materials, including olefin-based homopolymers and copolymers, such as polyethylene, polypropylene, ethylene propylene copolymer, ethylene vinyl acetates, polyamides and polyamide derivatives, acrylics, polyesters, and the like, so long as the resulting fabric provides both a barrier to passage of air and susceptibility to being readily cut to create slit/opening 128.

FIGS. 13A-13G represent a sequence of steps performed in the process of attaching a brace to respective rafter and purlin when a one-piece brace cover 122 extends about the brace. The building structure of FIGS. 13A-13G includes rafters and purlins, the purlins extending transversely across the rafters such that the rafters support the purlins. FIGS. 13A-13G illustrate respective different steps in a process that includes installing a suspension fabric, attaching the brace to the purlin through the suspension fabric, and installing the brace cover. Relative sizes and dimensions of some of the components and features in FIGS. 13A through 13G, and in others of the drawings herein which are schematic in nature, may not be entirely representative or typical of the relative sizes and dimensions of standard parts used in the metal building industry, nor of the parts used in any particular building. Nevertheless the drawings illustrate relevant principles involved in the installation of the disclosed brace covers.

Figure 13A:
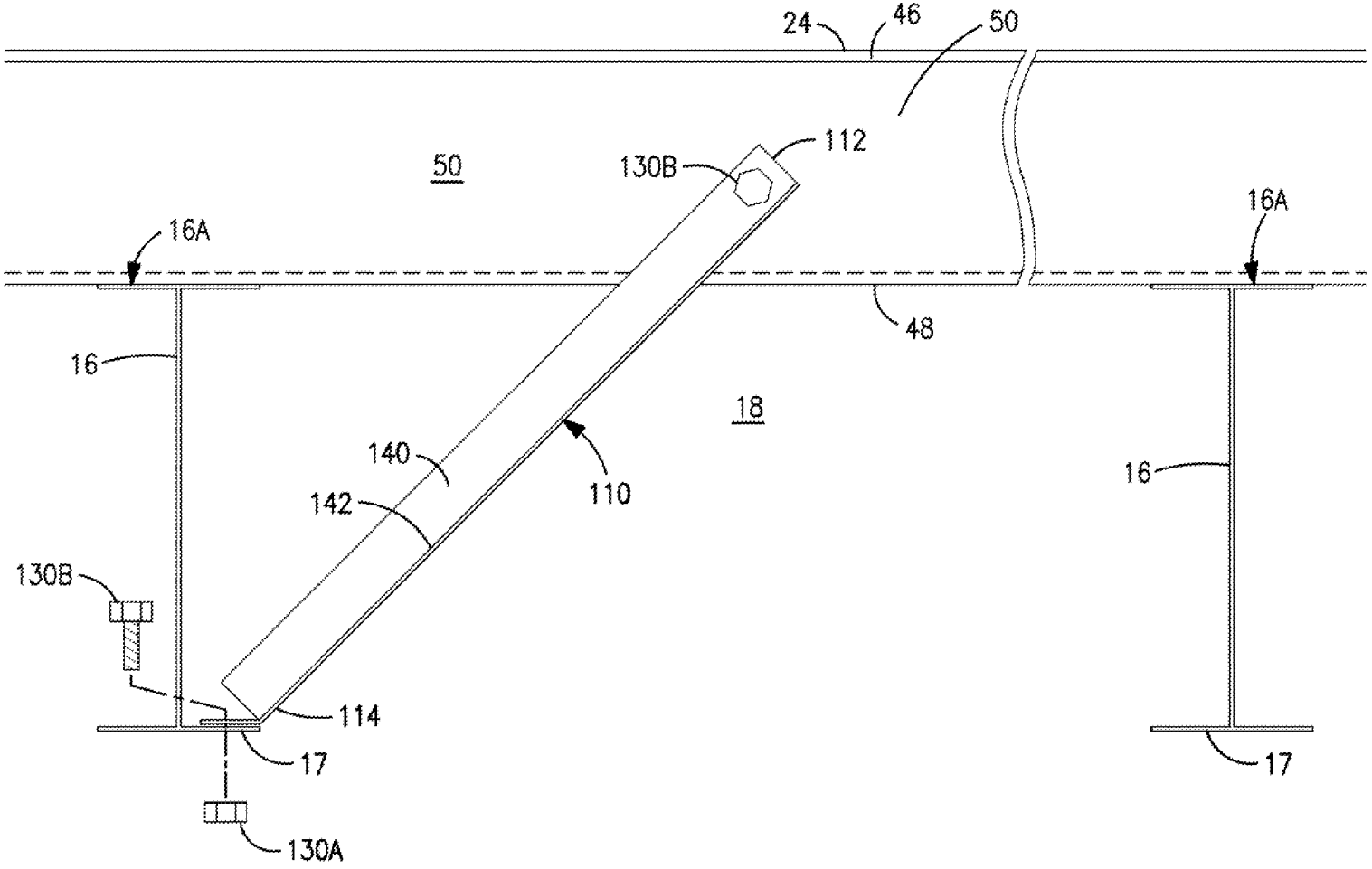
FIGS. 13A through 13G are a sequence of schematic side views of a portion of a building structure, illustrating how building elements including a rafter, a purlin, and a flange brace appear from this vantage point during different steps in a process which includes installing a suspension fabric, attaching the brace to the purlin through the suspension fabric, and installing the brace cover.

FIG. 13A shows a portion of the building structure including a purlin 24 and rafters 16. The purlin 24 is supported by the rafters and contacts the upper surfaces 16A of the rafters. The rafters 16, which extend into and out of the plane of the drawing and are shown in simple schematic form, define a bay 18 across which purlin 24 extends.

Purlin 24 expresses a "Z"-shaped cross-section, as shown above in FIG. 6. The purlin thus has a top flange 46, a bottom flange 48, and an upstanding web 50. In a typical but non-limiting example, the vertical dimension (height or depth) of the web 50 may be 8.5 inches, and the transverse dimension (width) of each of the flanges 46, 48 may be 2.5 inches.

Rafter 16 may be an I-beam with an I-shaped cross-section as shown, but in any case the rafter includes a bottom flange 17. In a typical but non-limiting example, the vertical dimension (height or depth) of rafter 16 may be 16 inches, and the transverse dimension (width) of the entire lower flange may be 4 inches.

A flange brace 110 connects purlin 24 to rafter 16, e.g. to enhance the structural strength, and thus the integrity, of the building structure. More particularly, flange brace 110 is securely fastened or attached to bottom flange 17 of the rafter at lower end 114 of the brace. At the upper end 112, brace 110 is securely fastened or attached to web 50 of purlin 24, preferably at a central location half way between top and bottom flanges 46, 48 of the purlin. The secure attachment at the ends of brace 110 may be made by an appropriately sized nut 130A and bolt 130B combination, which may extend through holes 115 in brace 110 such holes 115A, 115B being shown at both ends of the brace in FIG. 8. Other secure attachment mechanisms can also be used, for example in some cases rivets or weld joints. However, at least the attachment of upper end 112 of the brace to purlin 24 is desirably reversibly attachable, for reasons that will become apparent in the discussion which follows.

A given brace 110, and the purlin which the respective brace connects to, may be considered a brace/purlin combination. Although brace 110 is shown as an angle brace in FIGS. 13A through 13G and FIG. 14, brace 110 may have any other suitable cross-section configuration or design as discussed above.

In FIG. 13A, the building structure is shown in a state or condition before the suspension fabric has been installed across bay 18 and where both the upper and lower ends of each brace are secured to the respective rafter and the respective purlin. Thus, in typical metal building construction, all or substantially all, of the rafter/purlin combinations which will be braced in the respective building have had their braces applied and secured before the suspension fabric is installed. At that stage of the construction, substantially the entirety of the structural integrity of the building support structure which will be provided by the braces in the finished building, has been created.

The overall objective of use of the suspension fabric is to install the fabric below the purlins and above the rafters, in such a manner that the fabric spans substantially the entire distance between the rafters in a given bay, even at and proximate braces 110. As the fabric is installed, the fabric is first generally laid out across the bay, and along the lengths of the respective rafters. With the fabric so laid out and extending rafter-to-rafter across the bay, a given brace is individually temporarily disengaged, and temporarily moved out of the way of the space to be occupied by the suspension fabric. The necessary work is then done to extend that brace through the fabric, to position and mount the cover about the brace, and to seal about the cover so as to prevent movement of air from the bottom of the fabric to the top of the fabric, or vice versa.

The respective braces are thus disconnected one at a time, or a few at a time, while leaving the majority of the braces fully connected to their respective rafters and purlins such that the building structure continues to benefit from the structural strength provided by the braces, as a brace set, even while the process of installing the brace covers, and sealing about brace covers, is taking place.

Thus, a given brace, which has first been connected to both the respective rafter at the lower end of the brace, and the respective purlin at the upper end of the brace, is disconnected from the purlin and moved out of the way of the fabric. After the respective portion of the fabric has been positioned across the space previously occupied by that brace, the upper end of that brace is reconnected to the purlin. Typically, only after that brace has been fully reconnected to the purlin does the respective worker or worker team move on to disconnect another brace.

Certainly, multiple workers can be working on multiple braces in a given building at the same time. But overall, at any given point in time, most of the braces, at both their upper and lower ends, are connected to their respective rafters and purlins whereby the benefits of the use of braces remains in effect in the building structure even while the braces are being worked through the fabric.

The invention contemplates that, in some instances, the upper ends of a small fraction of the braces may not be connected to the respective purlins before the suspension fabric is installed. However, that, fraction of braces which are not installed is small enough to assure the contractor that the building structure is adequately braced against most weather conditions for which the building is designed, and against all of the weather conditions expected to occur before all of the braces are fully connected, both to the respective rafter and to the respective purlin.

Figure 13B:
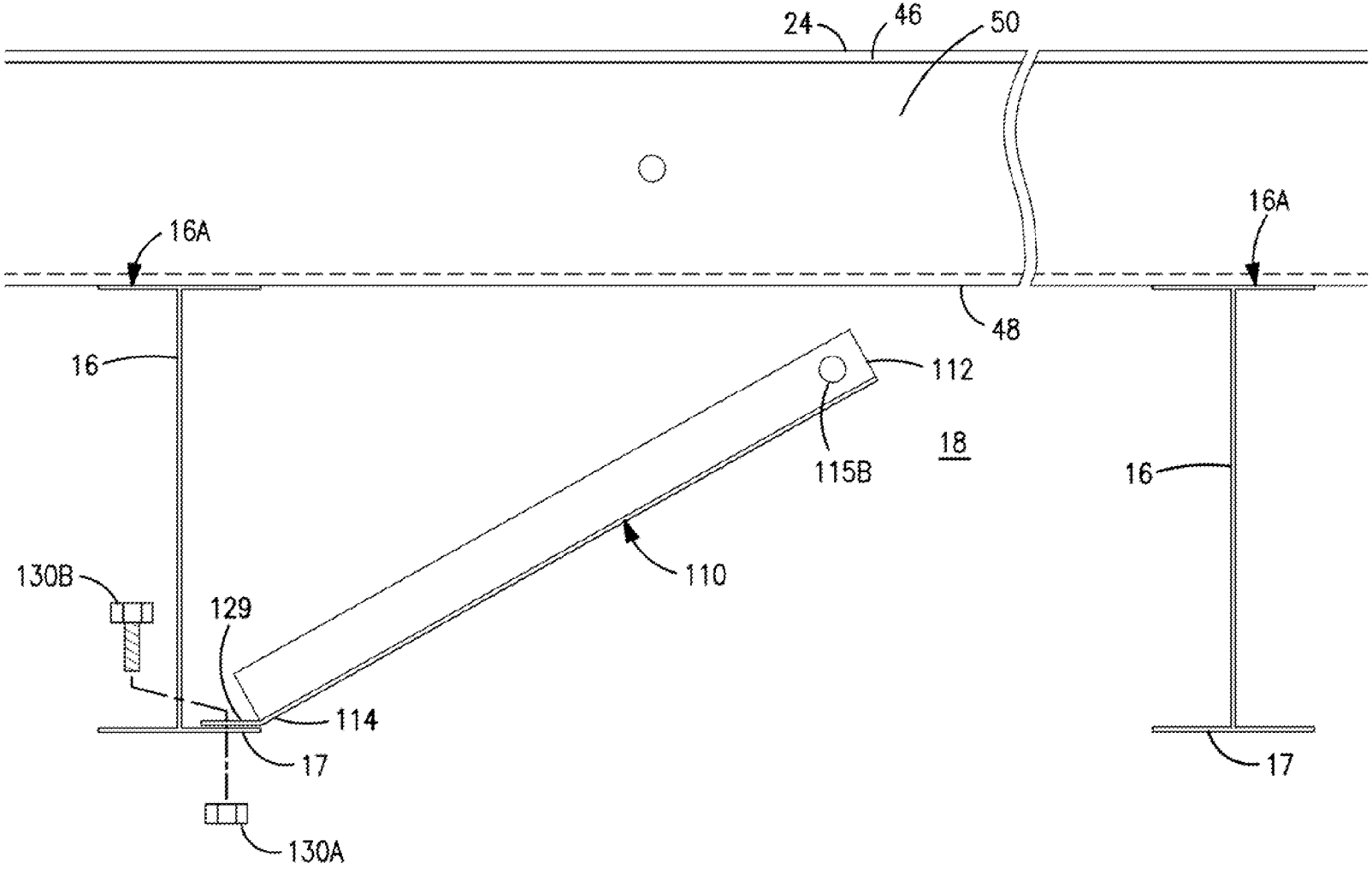

FIG. 13B illustrates the first step in the process of extending a brace through the suspension fabric, namely where upper end 112 of the brace has been detached/ disconnected from the purlin 24, e.g. by removal of the nut/bolt combination 130A/130B at that end, and a worker has moved, e.g. bent, brace 110 downward at lower flange 129 so that upper end 112 of the flange is below the level of the bottom of flange 48 of the purlin. In this configuration, hole 115B in brace 110 and hole 133 in purlin 24 which two holes were used to make the upper nut/bolt attachment, are now visible. During this procedure, lower end 114 of brace 110 may remain connected to bottom flange 17 of rafter 16.

In FIG. 13B, upper end 112 of the brace is detached/disconnected from the purlin and has been lowered to an elevation below the bottom surface of the bottom flange of the purlin.

Figure 13C:
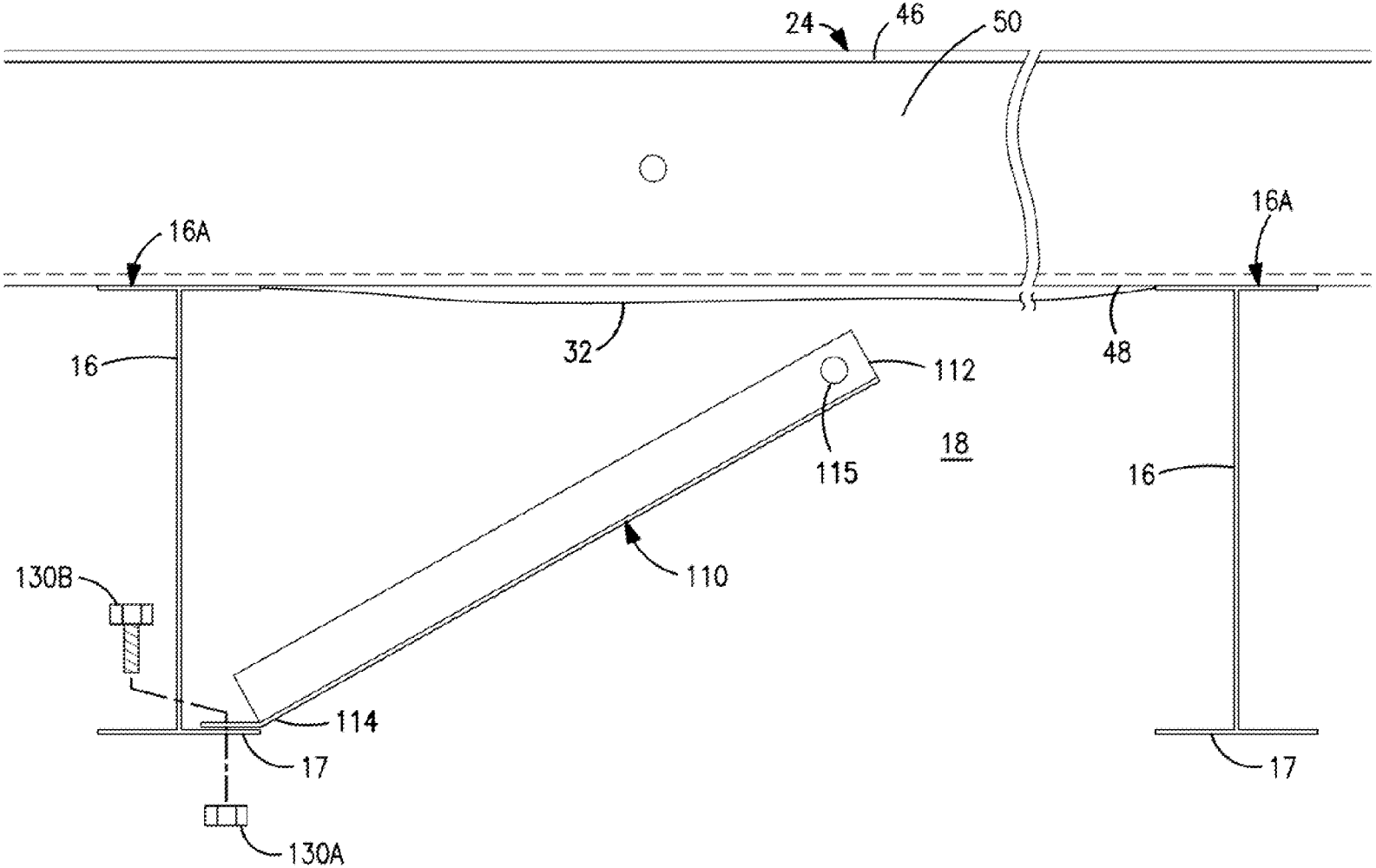

In FIG. 13C, the suspension fabric has been laid out and extended across the respective bay 18, including in the vicinity of the brace 110. In some instances, the fabric is laid out and extended across the bay before any upper end of any of the braces has been detached.

In FIG. 13C, as well as in others of the drawings, the longitudinal and lateral metal bands which would normally be used to help support the fabric in spaces between rafters are not shown for simplicity and clarity of the drawings. However, such longitudinal and lateral bands may be included in the structure, to the extent they are needed in the particular application as illustrated e.g. in FIGS. 2, 3, and 7. FIG. 13C differs from FIG. 13B by illustrating suspension fabric 32 extending across bay 18 below purlins 24 and above rafters 16. FIG. 13C illustrates a moderate amount of sag in suspension fabric 32 between the respective rafters 16. At locations where purlin 24 contacts and overlies upper surface 16A of rafter 16, fabric 32 is notched such that the edges of the fabric at the notch extend along, and close to, both sides of the bottom flange of the purlin and onto the top surface of the respective rafter 16 and the base of the notch extends along, and close to, the near edge of the respective rafter. Such notch structure is illustrated in e.g. FIG. 17A.

With the suspension fabric extending across the bay, under the purlins and over the respective rafters, a slit is cut in the suspension fabric near the location of brace 110 so that brace 110 can be pushed/bent up through the slit in fabric 32 and re-attached to the overlying purlin. The cutting provides the slit or opening 32A in the fabric 32, shown generally in FIG. 13D. Typically, opening 32A directly underlies bottom flange 48 of purlin 24, spaced from the inner edge of flange 48 such that an upward force on the fabric, such force being located immediately on either side of the slit, impacts directly on the bottom surface of bottom flange 48 of the purlin. Fabric opening 32A is typically long enough, e.g. on the order of 6, 8, or 10 inches in length, so that a worker can reach both hands through opening 32A to re-attach upper end 112 of brace 110 to the overlying purlin 24 with nut/bolt combination 130A, 130B or other attachment mechanism.

Figure 13D:
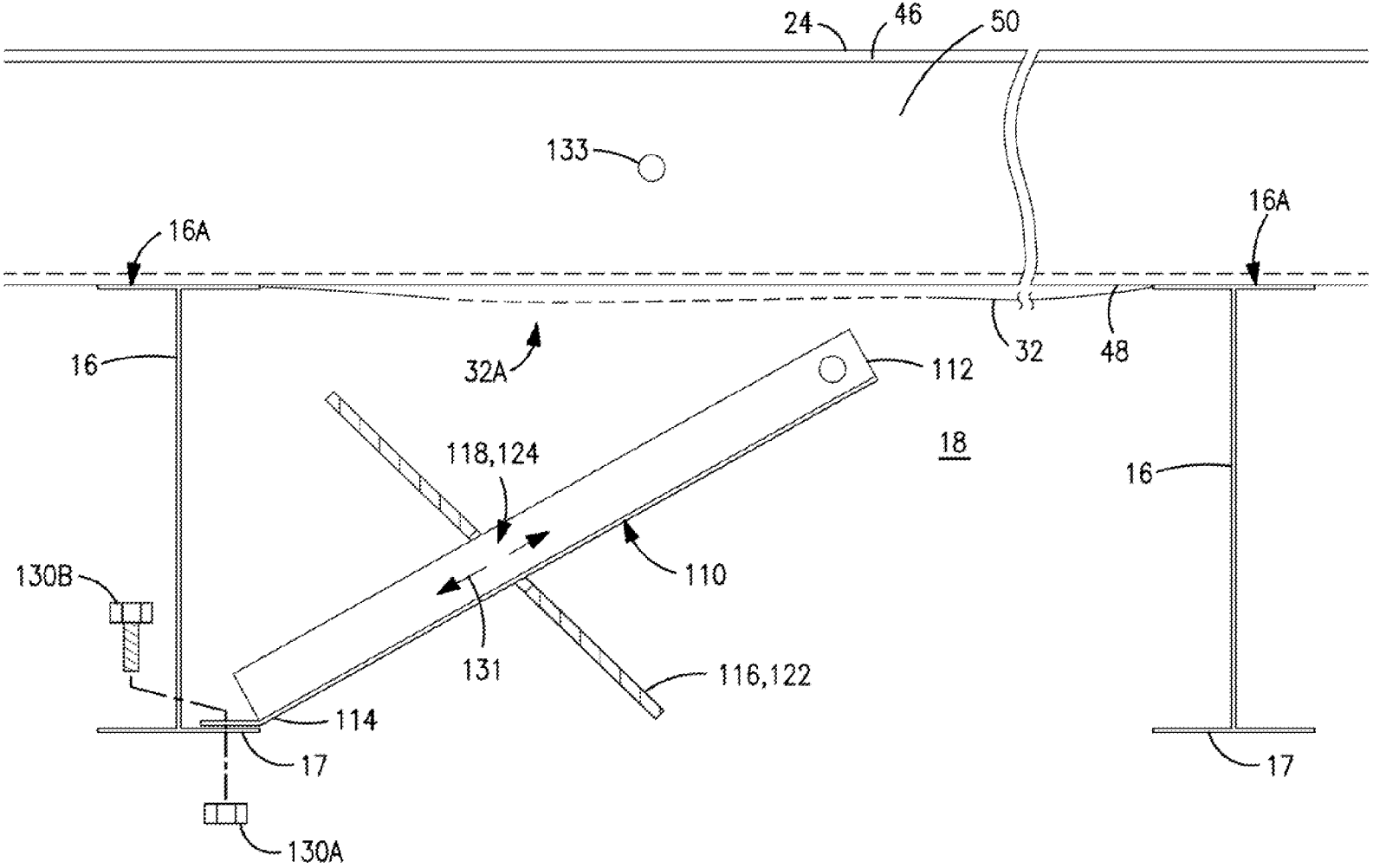

While upper end 112 of the brace is disconnected from purlin 24 as illustrated in e.g. FIG. 13D, a brace cover 122 can be mounted about the brace. Mounting cover 122 to the brace while upper end 112 is disconnected is particularly important when the brace cover employs a plate having a 1-piece construction and a continuous perimeter spaced from an aperture which extends through the plate, such that, to install the cover on the brace, some portion, such as the end, of the brace must be passed through such aperture in the plate. In FIG. 13D, for simplicity, brace cover 122 is shown as having a plate 116 with such aperture, such that the plate aperture 118 and cover opening 124 generally describe the same passageway extending through the plate.

In other embodiments, brace cover 122 further includes a fabric piece 126 mounted on plate 116 as illustrated and discussed in connection with FIGS. 10 and 11. In such cases, the brace cover may be provided in an initial state which includes a plate and a fabric piece, the plate having a plate aperture 118, and the fabric piece being attached to the plate such that the fabric piece covers the plate aperture, the fabric piece being imperforate at least in a region corresponding to the plate aperture such that the fabric piece closes off passage of air through the opening in the plate, which opening is defined as plate aperture 118. Referring to FIGS. 11, 12, and 12A, a slit 128 is formed/cut in fabric piece 126 in the region corresponding to plate aperture 118, and the unattached upper end 112 of the brace is then passed through slit 128 and through plate aperture 118. The unattached end of the brace can be made to pass through slit 128 and through plate aperture 118 by holding the brace stationary and moving the plate, or by holding the plate stationary and moving the brace, or by moving both the brace and the plate. Of course, when the lower end 114 of brace 110 is secured to lower flange 17 of rafter 16, as is typically, but not always, the case, the passing is generally accomplished by moving plate 116 while not moving the brace longitudinally. Although brace cover 122 is placed on the elongate brace such that the brace extends through plate aperture 118 and cover opening 124, brace cover 122 is not yet in its final position, e.g., the brace cover can slide, or be slid, longitudinally along the length of the brace as shown generally by longitudinally-extending arrows 131 in FIG. 13D.

Figure 13E:
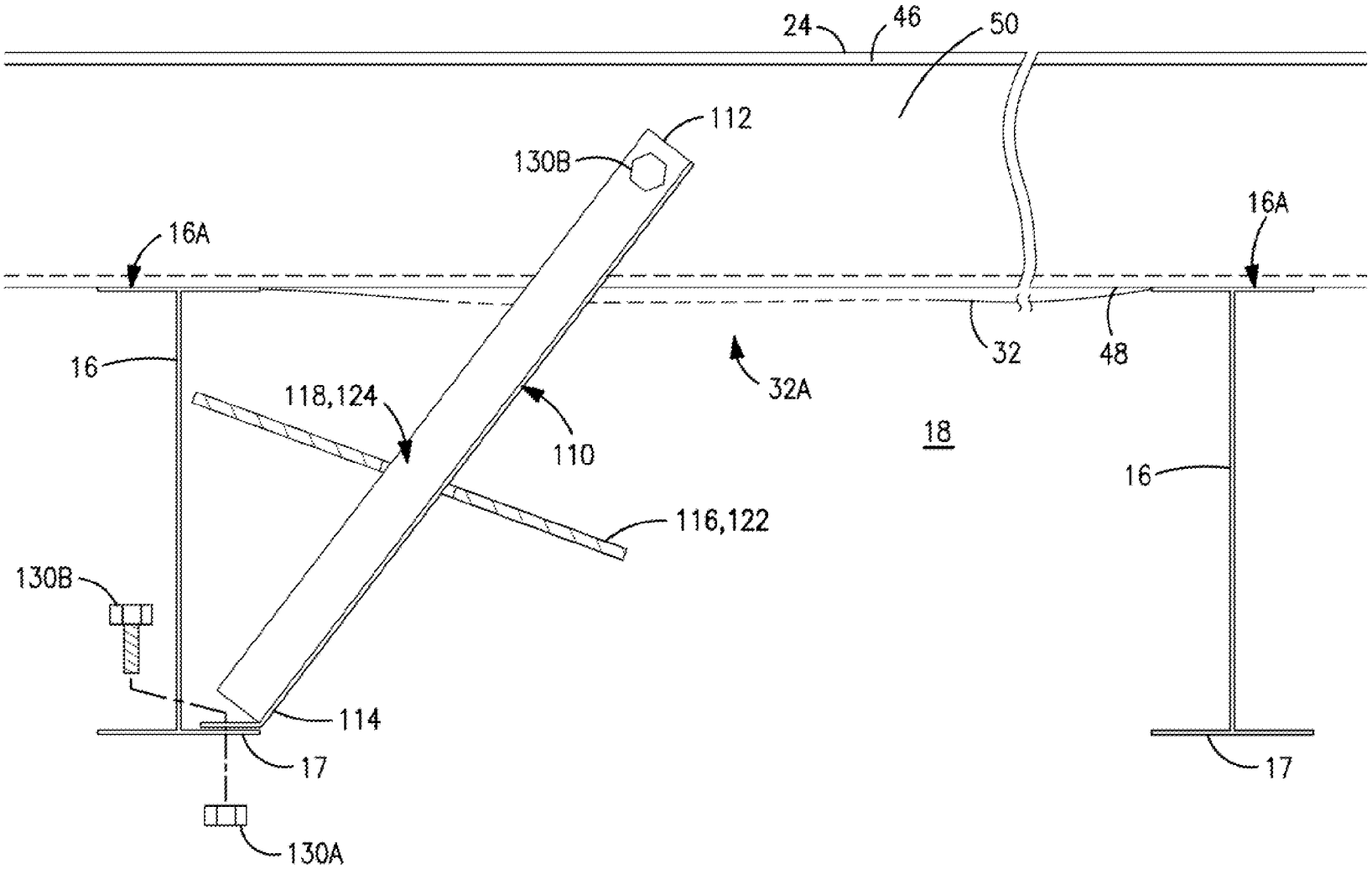

After the step shown in FIG. 13D, flange brace 110 is e.g. bent back upwardly to its connection point with purlin 24 at aperture 133. In performing this operation, upper end 112 of brace 110 is made to pass through fabric opening 32A. FIG. 13E shows the brace passed through opening 32A where, for example, a worker has extended his hands through aperture 32A in the process of manipulating nut/bolt combination 130A, 130B through apertures 115, 133 so as to re-attach the upper end 112 of the brace to web 50 of the respective purlin. After the upper end of the brace has been so attached to the purlin, some portions of the edges of fabric opening 32A are spaced from the surfaces and/or edges of brace 110. At this stage, preliminary repairs or patching can be performed on the fabric to at least partially close off such spaces about opening 32A.

For example, patch tape 136 (FIG. 16D) can be applied to partially or completely close any gaps 138 associated with such spaces. Additionally or in the alternative, a sealant, such as a conventional tube sealant, can be applied to partially or completely close gaps between the slit edges of suspension fabric 32 and brace 110. Such sealant is not shown in FIG. 13F, but is shown and described elsewhere herein.

Figure 13F:
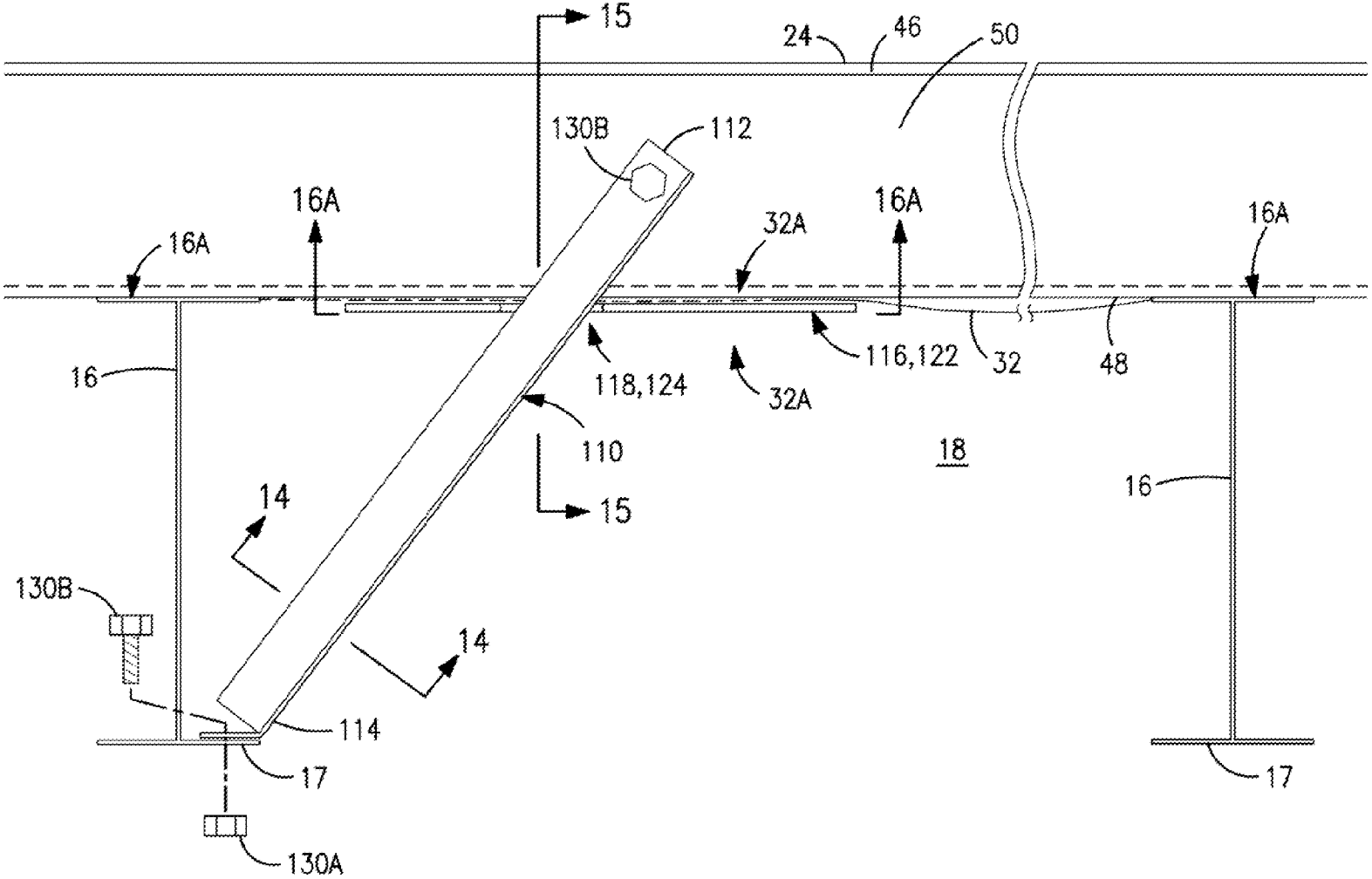

After upper end 112 of brace 116 has been reattached to the purlin at aperture 133, brace cover 122 can be installed at its intended position, as shown schematically in FIG. 13F. In the case of a brace cover 122 having a 1-piece plate 116, before securing upper end 112 of the brace to purlin 24, cover 122, including plate 116, is installed or pre-installed in a preliminary step by passing the then-unattached upper end 112 of the brace through plate aperture 118 and cover opening 124. Then, after the upper end of the brace is secured to the purlin, plate/cover 116/122 is slid upwardly along the length of brace 110 until the plate/cover contacts suspension fabric 32. Then, with a portion of the suspension fabric 32 disposed between plate/cover 116/112 and bottom flange 48 of the purlin, plate/cover 116/122 is pressed against, and affixed to, the bottom flange 48 of the purlin 24, e.g. using one or more Tek screws.

A brace cover 122 having a 2-piece plate 116, such as any of those described further below, can be installed in a similar way as the 1-piece plate, except that there is no need for the preliminary pre-installation step of passing the plate through the brace while the end of the brace is unattached. Rather, the 2-piece plate can be installed around the flange brace 110 even when the ends of the brace 110 are secured to their respective rafter and purlin whereby the steps of disconnecting and reconnecting the upper end of the brace from and to the purlin can be omitted.

Figure 13G:
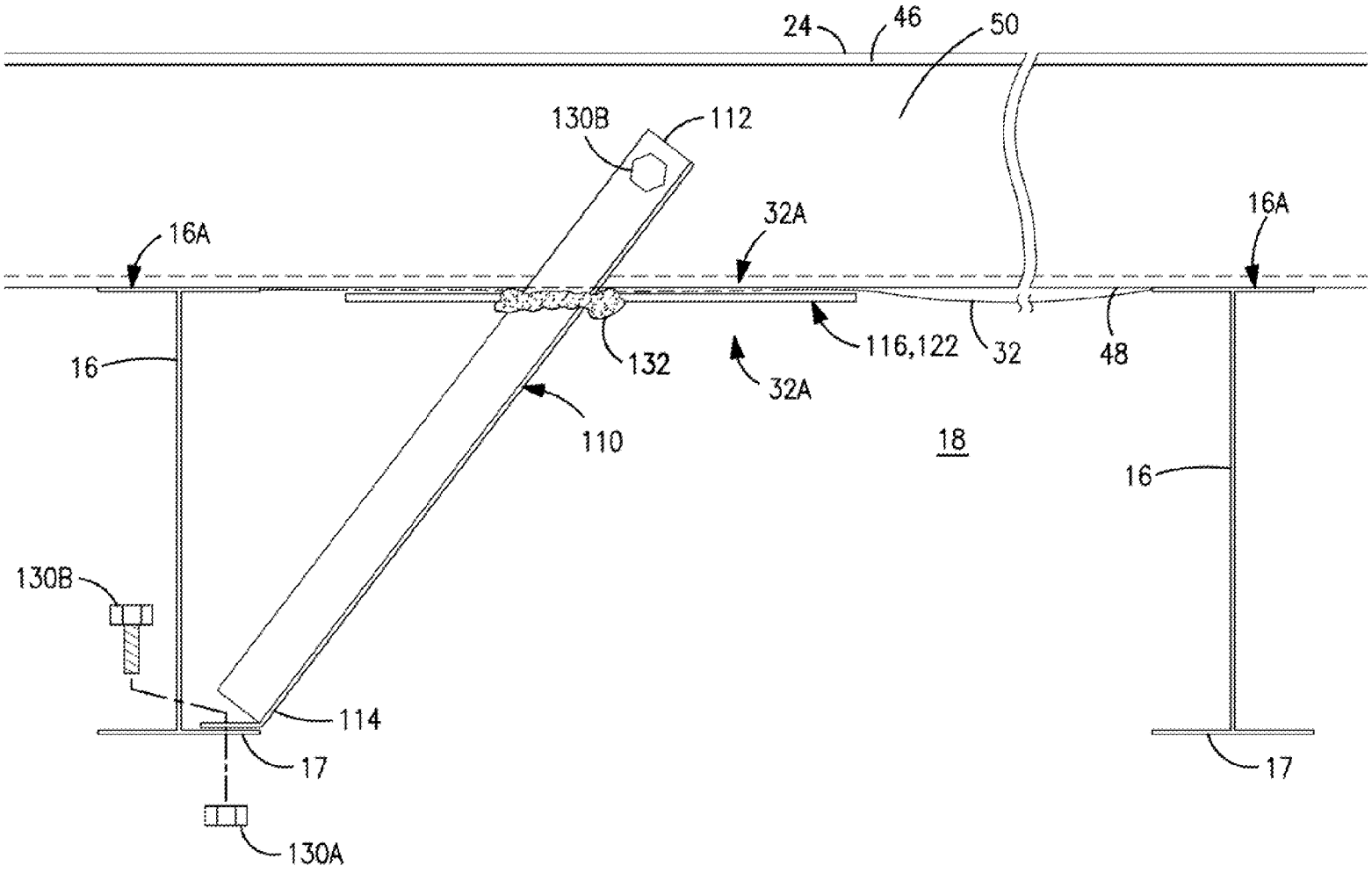

Finally, as shown in FIG. 13G, a suitable e.g. tube sealant 132 can be applied about the brace at the location where brace 110 passes through cover opening 124, thus sealing the cover opening 112 against passage of e.g. ambient air through the cover opening.

Figure 14:
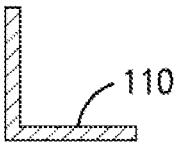
FIG. 14 is a schematic cross-section taken along line 14-14 in FIG. 13F.

FIG. 14 is a schematic cross-section taken along line 14-14 in FIG. 13F. FIG. 14 shows the profile of the illustrated flange brace 110 in transverse cross-section, i.e., in a plane oriented perpendicular to the longitudinal axis of the brace. Brace 110, as illustrated, has an L-shaped cross-section, wherein the legs of the "L" are of nominally the same length. The illustrated brace profile is merely exemplary, and braces having other profiles in transverse cross-section can also be used as discussed above.

Figure 15:
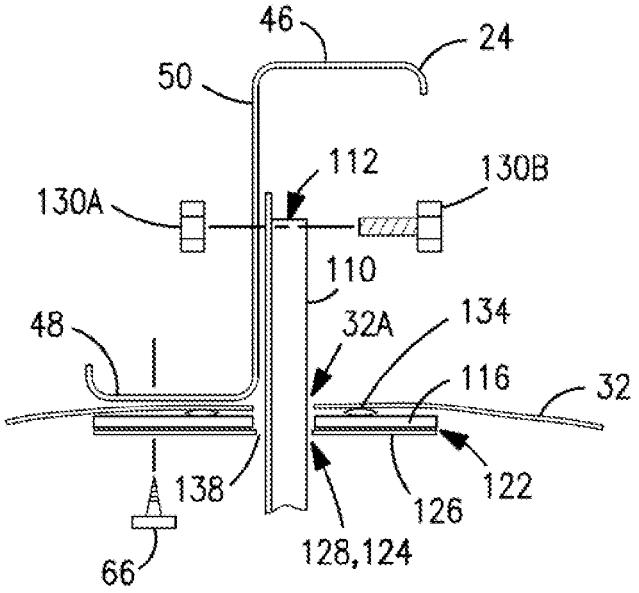
FIG. 15 is a schematic cross-section taken along line 15-15 in FIG. 13F.

FIG. 15 is a schematic cross-section taken along line 15-15 in FIG. 13F. From this perspective, the cross-section profiles of both the top 46 and bottom 48 flanges of purlin 24, as well as web 50 of the purlin, can be seen. Also, FIG. 15 shows brace 110 extending through fabric opening 32A, with upper end 112 on one side of the opening and lower end 114 on the other side of the suspension fabric. A nut/bolt combination 130*a*, 130B is positioned to secure upper end 112 of the brace to web 50 of purlin 24. A ring of sealant 134 is disposed between brace cover 122 and suspension fabric 32. Sealant ring 134 is shown in further detail in FIG. 18E, discussed following. One lateral side of brace cover 122 is secured to bottom flange 48 of the purlin, e.g. using Tek screws 66 or other suitable screws or attachment mechanism. The other lateral side of brace cover 122 is cantilevered or otherwise suspended, laterally away from bottom flange 48 of the purlin and contacts and supports a portion of suspension fabric 32 by virtue of the rigidity or stiffness provided by the e.g. metal or hard plastic properties of plate 116. With respect to the gaps which can be seen in FIG. 15 between brace 110 and brace cover 122, tube sealant 132 shown in FIG. 13G is applied to fill such gap. FIG. 15 is modestly inconsistent with FIG. 13F to the extent FIG. 15 depicts brace cover 122 as including a fabric piece 126, while the brace cover shown in FIG. 13F does not.

Figure 16A:
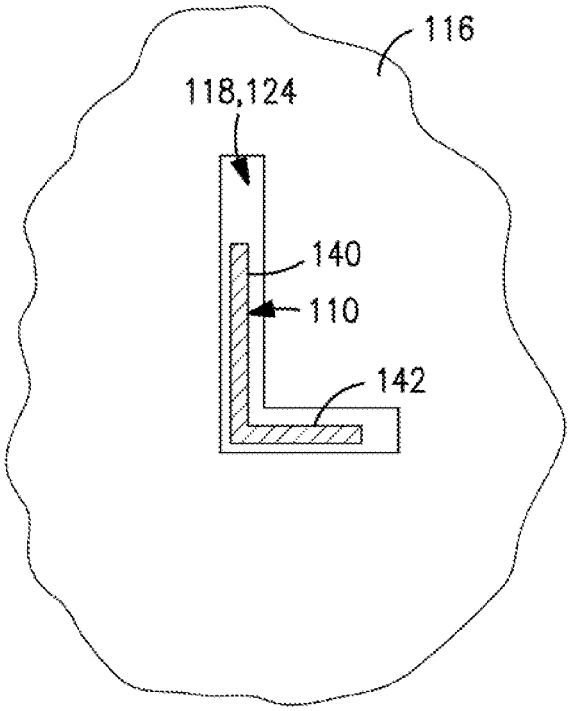
FIG. 16A is a schematic cross-section taken along line 16A-16A in FIG. 13F.

FIG. 16A is a schematic cross-section taken along line 16A-16A of FIG. 13F, and thus is taken to show a bottom view, looking up, of plate aperture 118 and/or plate 116 and/or brace cover 122. Due to the tilt angle of the brace 110 relative to brace cover 122, the upstanding/vertical leg 140 of brace 110 in FIG. 16A is elongated in the direction of the tilt, relative to the horizontal leg. Thus, when viewed from a perpendicular angle, in cross-section, the lengths of legs 140, 142 are equal. But when viewed from a non-perpendicular angle as in FIG. 14, the legs of the brace are no longer appear to be equal in length, and the thicknesses of legs 140, 142 no longer appear to be equal. For this reason, plate aperture 118 may similarly appear to be elongated in the elongate direction of the purlin relative to the cross-sectional profile of brace 110 when viewed from a non-perpendicular angle.

Figure 16B:
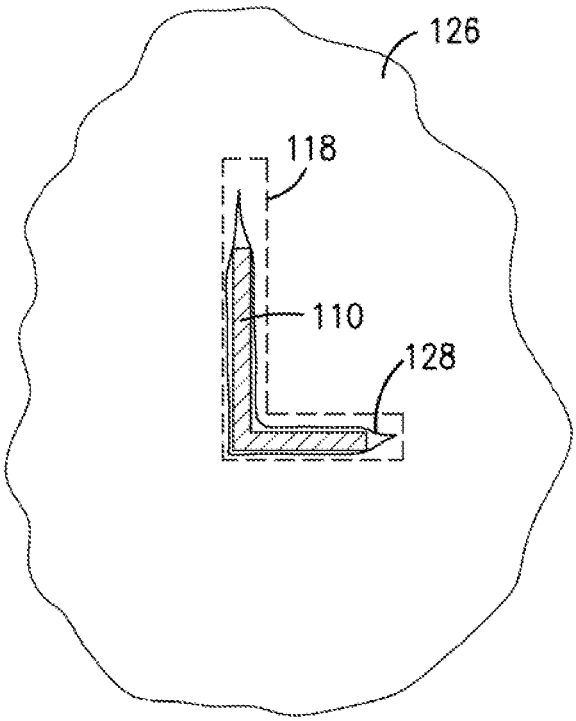
FIGS. 16B and 16C are schematic cross-sections similar to FIG. 16A but for alternative brace cover embodiments.
Figure 16C:
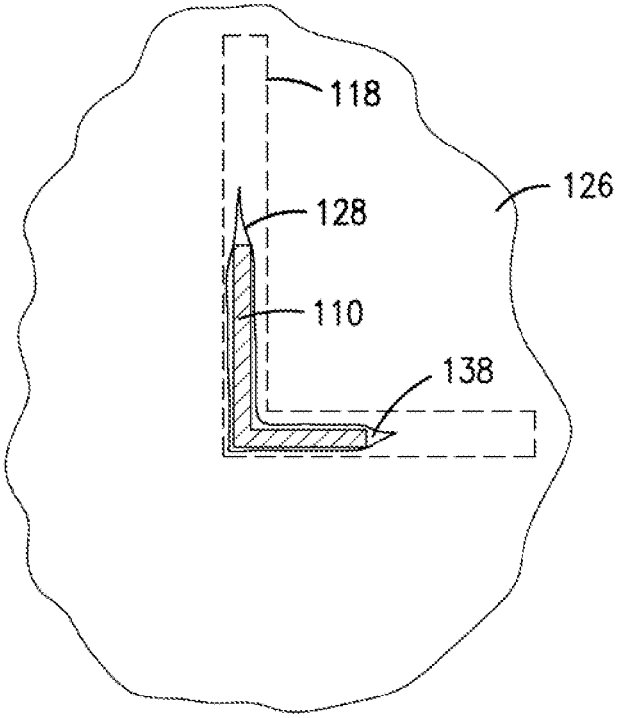

FIGS. 16B and 16C are schematic cross-sections similar to FIG. 16A but for alternative brace cover embodiments. In the embodiments illustrated in FIGS. 16B and 16C, the brace cover includes a fabric piece 126 more fully illustrated in FIGS. 10, 11, 12A and 12B. According to the cover embodiments illustrated in FIGS. 16B and 16C, a fabric piece opening 128, e.g. an L-shaped slit, conforms relatively closely to the profile of brace 110 as the brace passes through cover 122 at a non-perpendicular angle. Plate aperture 118 of FIG. 16C is larger, e.g. the aperture legs are larger than the plate aperture in FIG. 16B, e.g. to accommodate any of a variety of flange braces of different leg lengths.

Figure 17A:
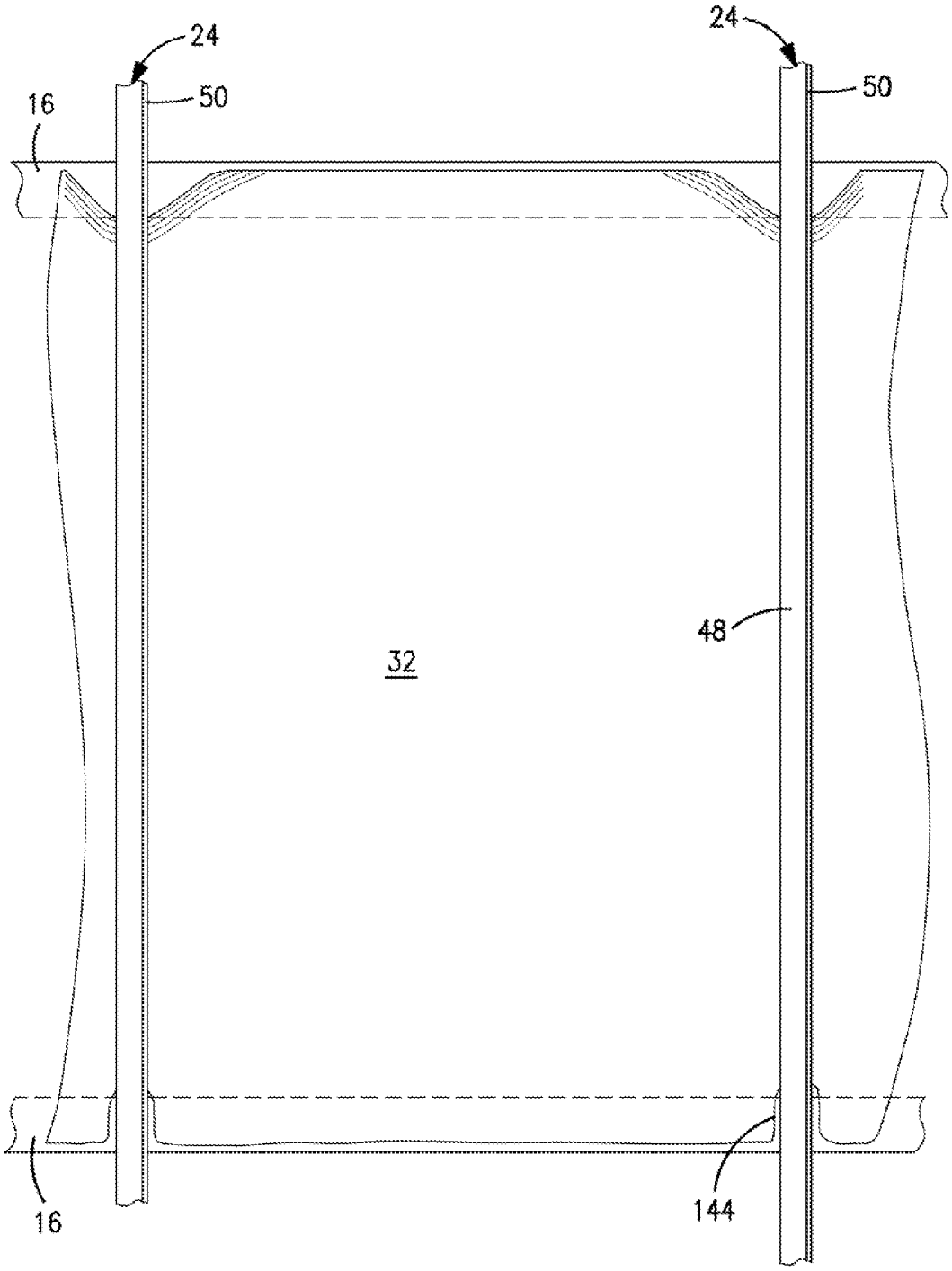
FIGS. 17A through 17C show a sequence of schematic views that look downward on a portion of a building structure from a plane which passes through two purlins below their upper flanges, illustrating how building elements including rafters, purlins, and a suspension fabric appear from this vantage point during different steps in a process of attaching flange braces to the purlins through the suspension fabric.
Figure 17B:
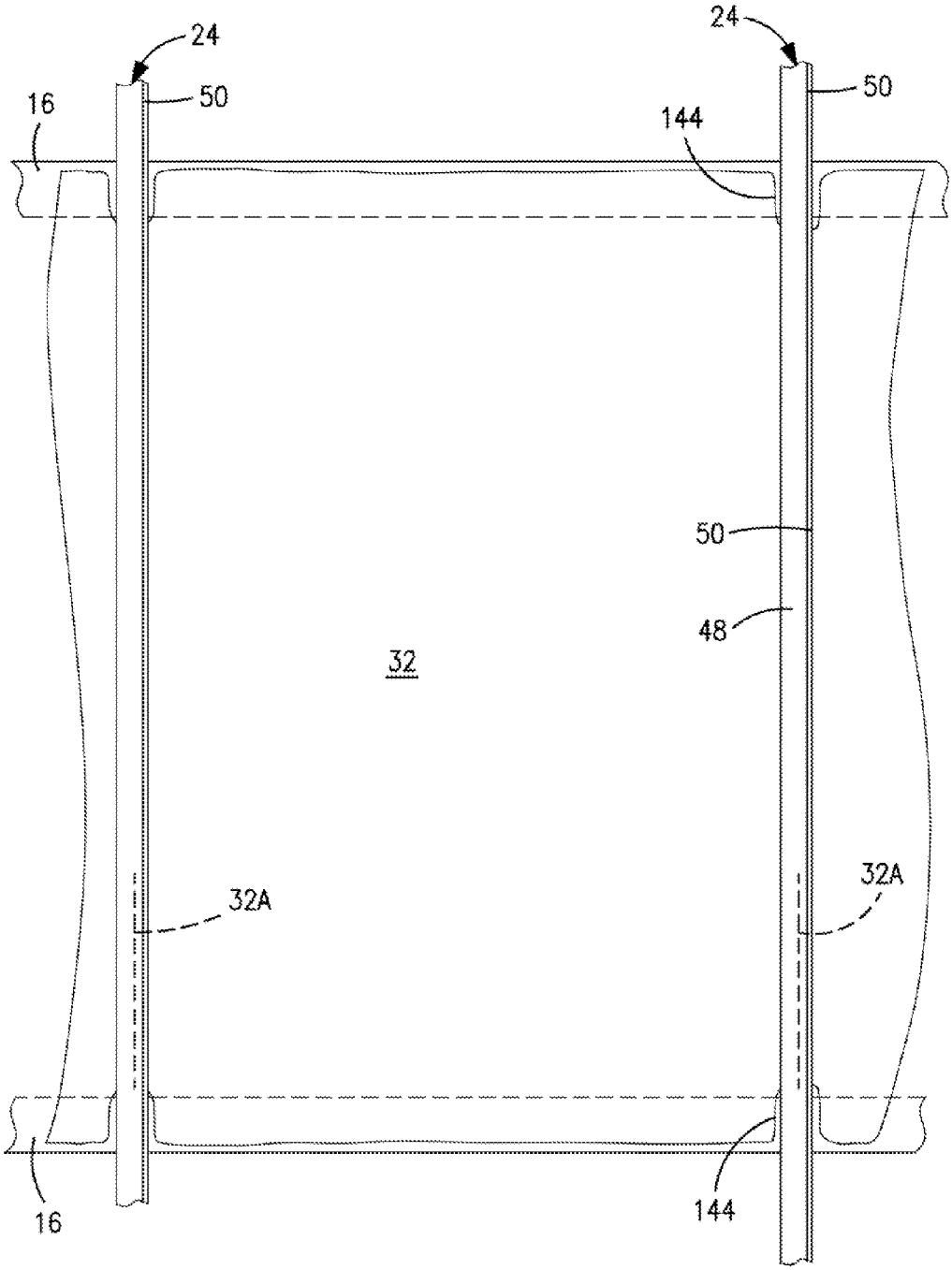
Figure 17C:
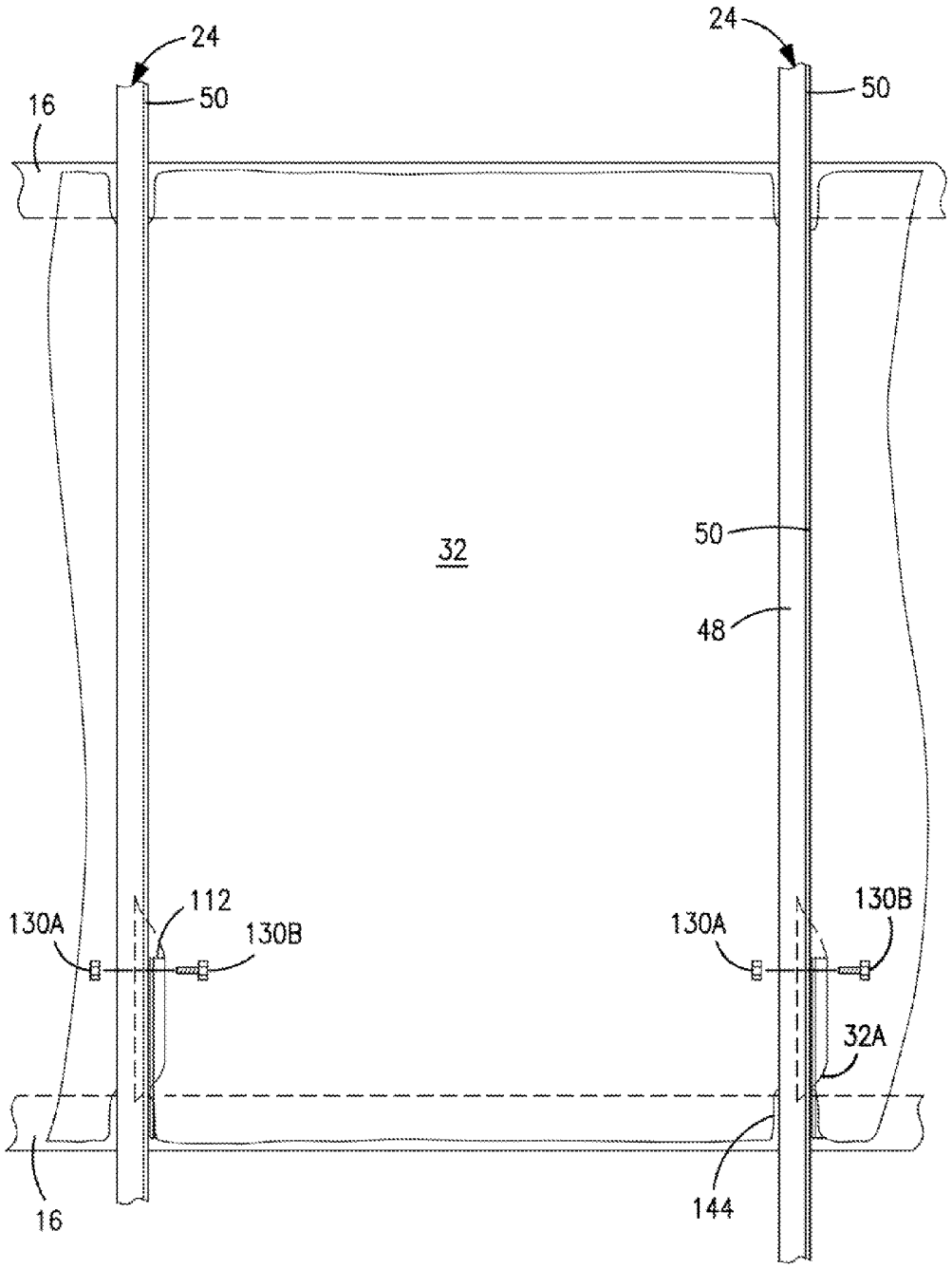

FIGS. 17A-17C illustrate a sequence of schematic views which look downward on a portion of a building structure from a plane which passes through two purlins below their upper flanges, illustrating from the downwardly-looking top perspective, some of the same steps illustrated herein from a side perspective in FIGS. 13A-13G. Referring back to FIGS. 17A-17C, top flanges 46 of the respective purlins are not shown in FIGS. 17A-17C in order to better show notches 144 in the fabric at the intersections of the purlins and the rafters. FIGS. 17A through 17C illustrate how building elements including rafters, purlins, and suspension fabric 32 appear from this vantage point. FIGS. 17A-17C particularly show how the fabric overlies, and can be attached to, rafters 16, while notches 144 enable the fabric to lie in a continuously generally planar configuration at the locations where the purlins overlie the rafters.

FIG. 17A illustrates a step similar to that shown in FIG. 13C, where the fabric has been extended across the bay between first and second rafters 16 and along the lengths of the rafters under multiple purlins 24. In FIG. 17A, the ends of the fabric at the bottom of the drawing show notches 144 having been cut into the edge of the fabric at the intersections where the fabric overlies the rafter. Legs of the notches extend generally parallel to the length of the purlin, slightly spaced from the purlin and on either side of the bottom flange 48 of the purlin. The base of the notch extends generally parallel to the length of the rafter, slightly spaced from the edge of the flange of the rafter, on the bay side of the rafter.

Also in FIG. 17A, ends of the fabric at the top of the drawing show the stress in the fabric before any notches have been cut in the fabric and where the fabric has been stretched onto the rafter.

FIG. 17B illustrates a step similar to that shown in FIG. 13D, where slit/opening 32A, shown as dashed lines, has been cut in the fabric underlying bottom flange 48 of the purlin. In FIG. 17B, notches 144 have also been cut into the edge of the fabric at locations where the purlins overlie the rafter at the top of the drawing.

FIG. 17C illustrates a step similar to that shown in FIG. 13E, where upper end 112 of brace 110 extends through slit/opening 32A in the fabric. At that step, hole 115 in the upper end of the brace is aligned with hole 133 in web 50 of the purlin, and bolt 130B and nut 130A are shown ready for bolt 130B to be inserted through holes 115 and 133 thus to re-attach the upper end of the brace to the purlin web.

FIGS. 18A-18G show a sequence of schematic views which look upward at a portion of a suspension fabric in a building near a location on a purlin where a flange brace is attached to the purlin. FIGS. 18A-18G illustrate how the suspension fabric and related building elements appear from this vantage point during multiple steps in a process which includes attaching a flange brace to the purlin through the suspension fabric and installing a brace cover.

Figure 18A:
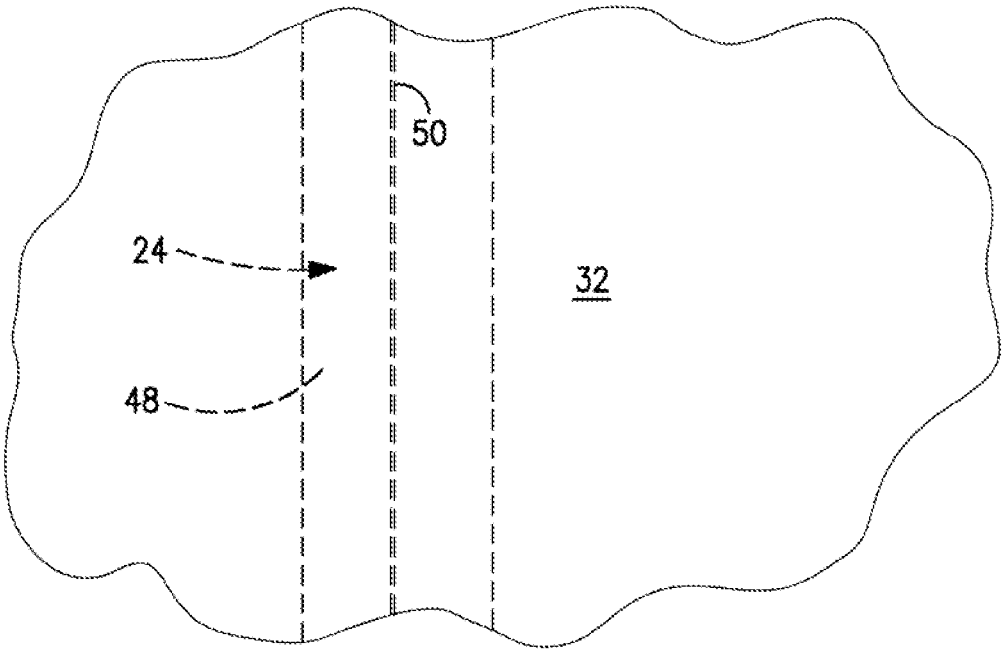
FIGS. 18A through 18G show a sequence of schematic views which look upward from below at a portion of a suspension fabric in a building near a location on a purlin where a flange brace attaches to the purlin, illustrating how the suspension fabric and related building elements appear from this vantage point during different steps in a process which includes attaching a flange brace to the purlin through the suspension fabric and installing a brace cover.

FIG. 18A shows a stage in the process of attaching a flange brace to the purlin through the underlying suspension fabric, similar to the stage shown in FIG. 13B, and wherein the outline of the elements of the overlying purlin, shown in FIG. 18A, are shown with dashed lines.

Figure 18B:
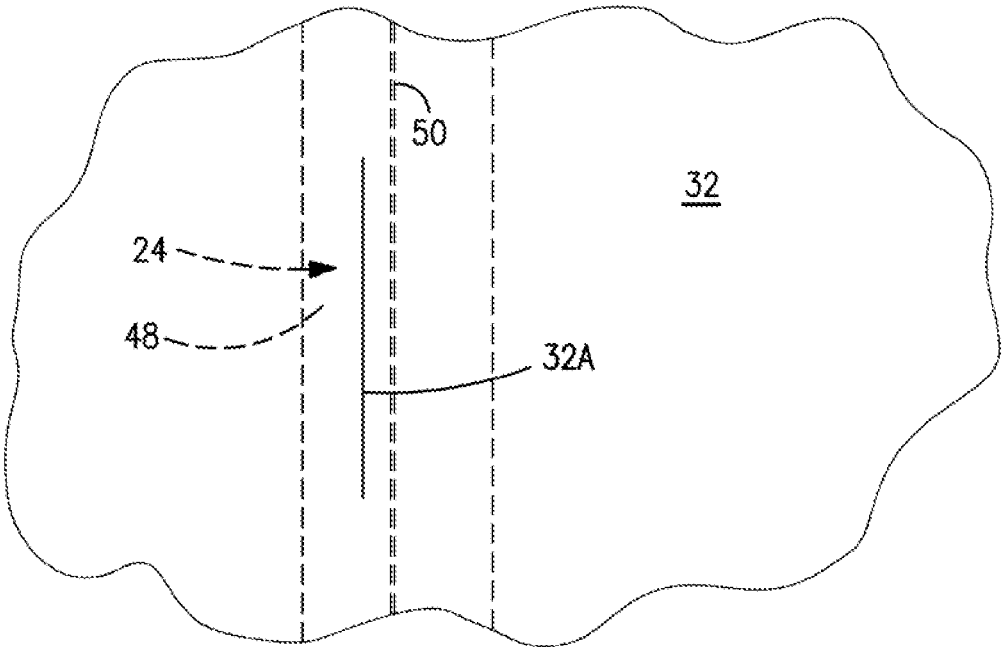

FIG. 18B shows a stage in the process of attaching a flange brace to the purlin through the underlying suspension fabric, similar to the stage shown in FIG. 13C, and where slit/opening 32A has been cut in the fabric, the slit/opening having been cut in the fabric at a location which underlies lower flange 48 of the purlin.

Figure 18C:
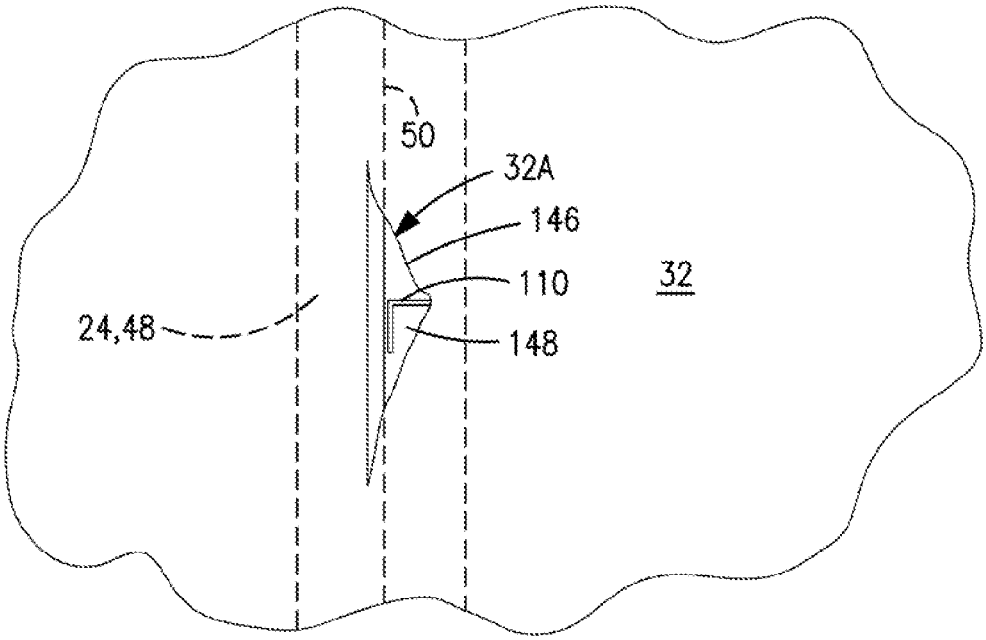

FIG. 18C shows a stage in the process of attaching the flange brace to the purlin through the underlying suspension fabric, similar to the stage shown in FIG. 13E, and where the brace is extending up through slit/opening 32A. FIG. 18C shows, particularly, that one side edge 146 of the slit/opening has been moved past the purlin web in order to extend the brace through the slit/opening 32A beside purlin web 50. As illustrated in FIG. 18C, the transverse movement of the one side 146 of the slit/opening away from the opposing such side creates a substantial passageway 148 for movement of e.g. ambient/cold air from e.g. the upper side of the fabric to the lower side of the fabric whereby such passageway presents a potential path for entrance of ambient air into the space enclosed inside the respective building. As suggested in FIG. 18C, and as obvious from use of bolt 130B and nut 130A, the vertical/upstanding leg of the brace is typically tight against upstanding web 50 of the purlin when secured to the purlin by nut 130A and bolt 130B. And even with the brace tight against the purlin web, opening 32A represents a potential path for convective movement of cold air into the building.

Figure 18D:
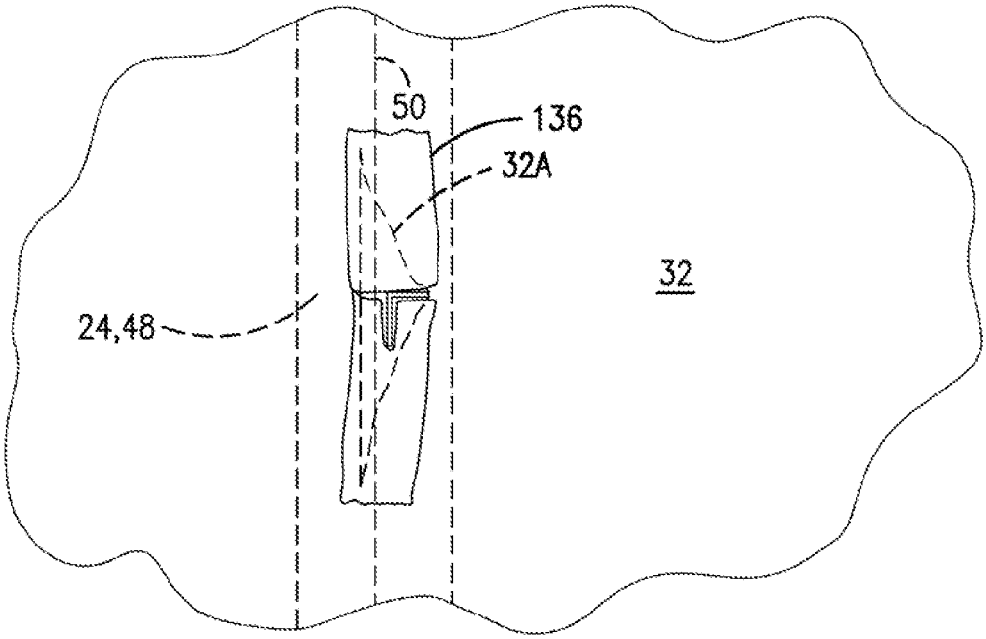

FIG. 18D shows a stage in the process similar to that of FIG. 18C, where first and second pieces/lengths of tape 136 have been applied to the lower surface of fabric 32, the lengths of the pieces of tape extending along the length of the overlying purlin. The pieces of tape have been cut/fabricated such that the ends of the tape which are close to brace 110 fit closely against the major surfaces of the brace where the brace extends through the fabric. As illustrated in FIG. 18D, the pieces of tape close off the majority of the cold air passageway/path created by extending brace 110 through slit/opening 32A. Thus, the tape functions as a first line of defense against movement of cold air through passageway 148.

In an embodiment not shown, after brace 110 has been inserted through slit/opening 32A as illustrated in FIG. 18C, and before tape 136 has been applied, slit/opening 32A is modified by creating a transverse cut, starting from the slit/opening, typically extending perpendicular to the length of the slit/opening shown in FIG. 18B. The transverse cut is made at the location where the horizontal leg of the brace passes through the fabric. The transverse cut creates two e.g. right angle corner pieces which can be used to close off most of the passageway between the remote edge of the horizontal leg of the brace and the web of the purlin. With those corner pieces lying generally in the plane of fabric 32, the opening represented by passageway 148 is substantially reduced in size. With the passageway so reduced in size, there is less passageway for the tape to close off, and the tape can attach to the right angle corner pieces much closer to the sides of the horizontal leg of the brace.

Figure 18E:
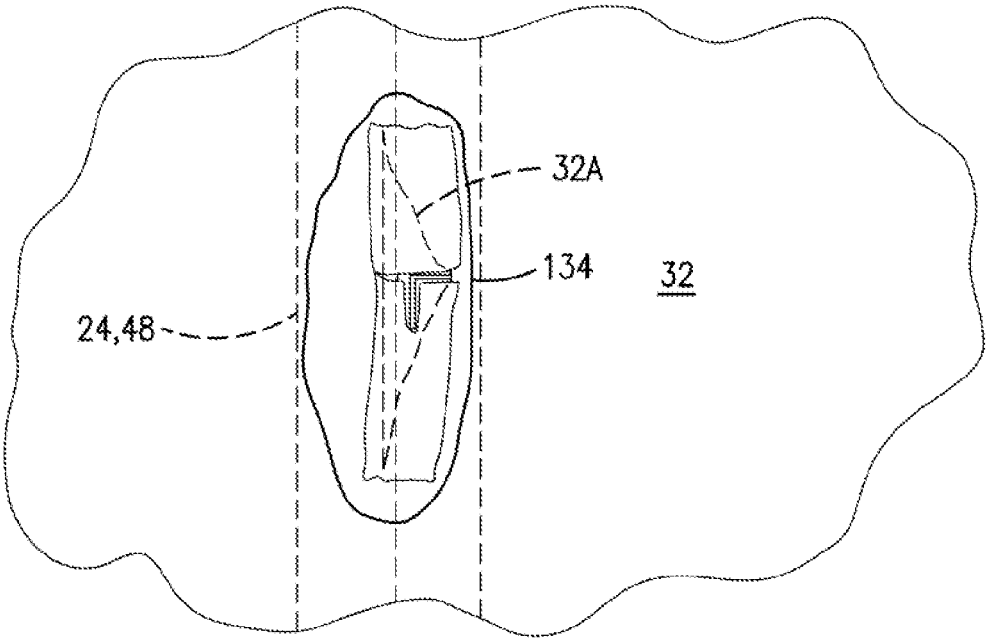

FIG. 18E shows a stage in the process similar to that of FIG. 18D, where a line of tube sealant has been applied to the bottom surface of fabric 32, completely surrounding passageway 148 and thus defining a closed loop of such sealant 134 about the passageway. In the illustrated embodiment, the closed loop also extends outwardly of the pieces of tape such that the tape pieces are disposed entirely within the closed loop of sealant represented as 134. For reasons illustrated hereinafter, it is desired that as much of the closed loop of sealant as possible be positioned underlying bottom flange 48 of the purlin, and that portion of the sealant which does not underlie the bottom flange be close to the bottom flange, however outside the edges of tape pieces 136. The closed loop of sealant is also shown, in cross-section, in FIG. 15.

Figure 18F:
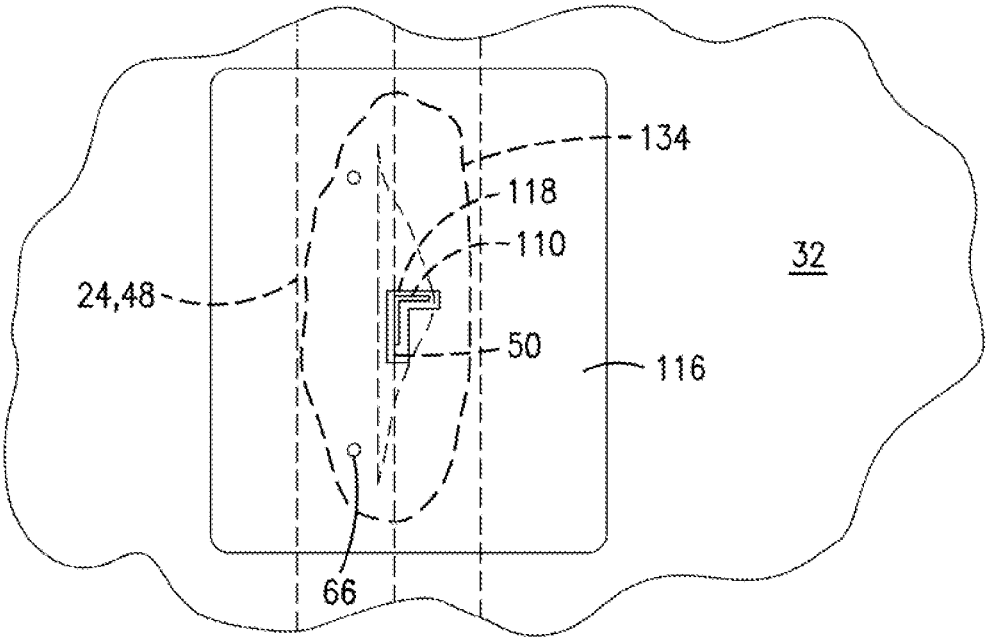

FIG. 18F shows a stage in the process similar to that of FIG. 18E, where the brace cover 122 has been mounted to the bottom flange of the purlin using e.g. Tek screws 66. The stage shown in FIG. 18F as an upwardly-looking view is similar to the step shown in elevation view in FIG. 13F. FIG. 18F shows approximately a first half of the brace cover extending to one side of web 50 and approximately a second half of the brace cover extending to the opposing side of the web. Screws 66 are driven tight into the bottom flange of the purlin whereby the screws hold the respective underlying portion of the brace cover tight against the bottom flange of the purlin whereby force urging the upper surface of the brace cover against the lower surface of the purlin bottom flange tightly engages a frictional entrapment of the fabric between the upper surface of the brace cover and the lower surface of the bottom flange of the purlin. The portion of the rigid brace cover which underlies the fabric under the upper flange of the purlin is cantilevered from the tight attachment of the brace cover to bottom flange 48, whereby the cantilevered portion of the brace cover extends from web 50 in a generally horizontally-extending plane, allowing for the slope of the overlying roof, thus the tops of the rafters.

At this stage of the process of installing the brace covers through the fabric, the fabric is typically stretched into a generally taught, generally horizontal orientation. With both the fabric and the cantilevered portion of the brace cover being in generally horizontal orientations, with the fabric trapped between the brace cover and the bottom flange of the purlin, and with the fabric subject to a modest drape due to the force of gravity, the cantilevered portion of the brace cover and the overlying portion of the fabric are extending generally parallel to each other and in surface-to-surface contact with each other.

Given the tight entrapment of the fabric between the brace cover and the bottom flange of the purlin and the parallel contacting surfaces of the fabric and the cantilevered portion of the brace cover, and with application of a thick enough bead of the tube sealant, the entirety of the closed loop of sealant 134 bridges the distance between fabric 32 and brace cover 110 about the entirety of the closed loop of sealant. Thus, the closed loop of sealant provides a second line of defense against movement of cold air through passageway 148 and into the interior of the building.

Accordingly, any cold air which manages to get past tape 136 at passageway 148 is prevented from entering the enclosed space of the building by lateral movement between brace cover 110 and fabric 32, by dosed loop 134 of tube sealant.

Figure 18G:
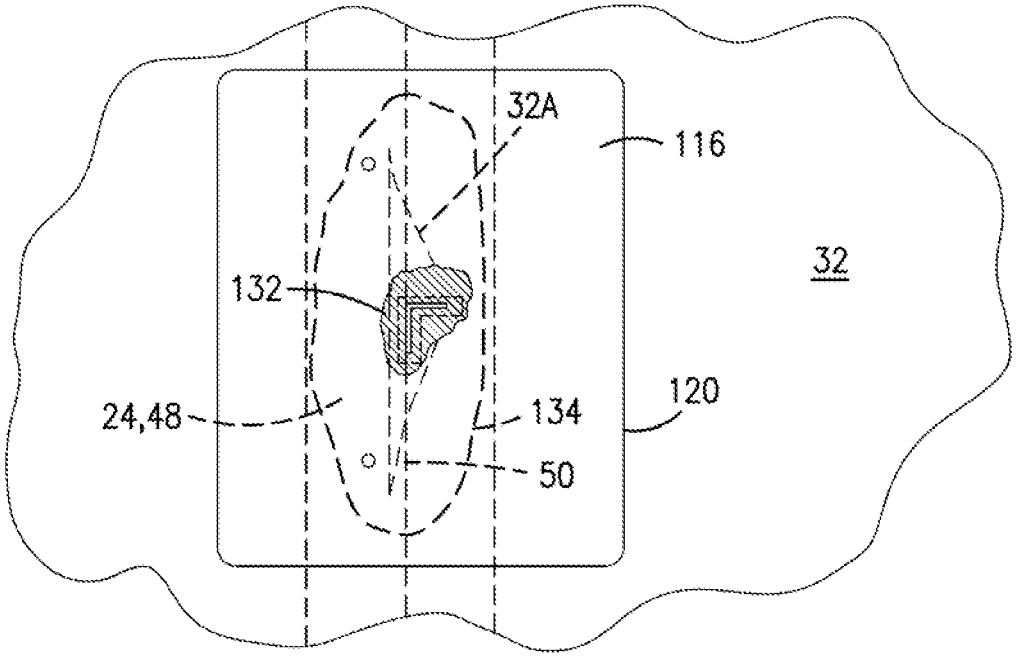

FIG. 18G shows a stage in the process similar to that of FIG. 18F, where an additional application of tube sealant 132 has been applied to the bottom surface of the brace cover at the location where brace 110 passes through the brace cover. Such application of tube sealant provides a flexible bridge into and across the spaces between cover opening 118, 124 and the surfaces of brace 110. The application of tube sealant 132 is the same sealant shown in elevation view FIG. 13G. As suggested in FIG. 13G, tube sealant 132 can extend entirely through aperture/opening 118, 124 in brace cover 122, and may reach and bond to tape 136 and/or fabric 32. Tube sealant 132 thus prevents passage of cold air through aperture/opening 118, 124 in brace cover 122, whereby tube sealant 132 provides a third line of defense against passage of cold/ambient air into the enclosed space inside the building.

Accordingly, the invention provides three lines of defense against infiltration of ambient air into the space enclosed by the building. The first line of defense is tape 136 which closes off most of passageway 148 at the fabric. The second and third lines of defense prevent substantially all passage of any residual air which gets past tape 136, into the space enclosed by the building. Closed loop 134 prevents movement of such residual air into the building by way of transverse paths between the fabric and the brace cover. Tube sealant 132 prevents movement of such residual air into the building by way of aperture/opening 118/124 in brace cover 122.

Figure 19A:
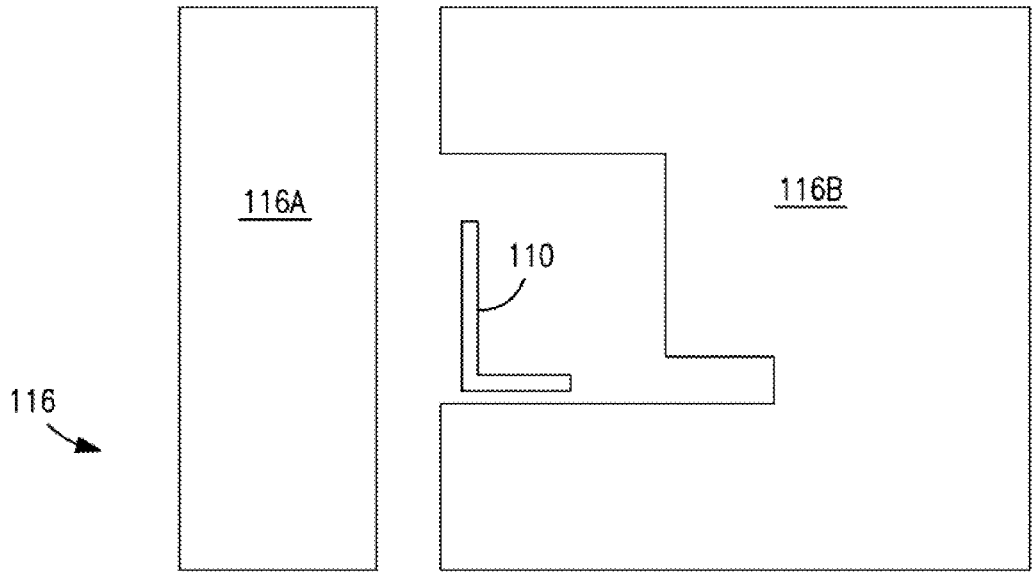
FIGS. 19A and 19B are upwardly-looking plan views of a 2-piece plate for use in the disclosed brace covers, FIG. 19A showing the two plate pieces of the plate separated and FIG. 19B showing the two plate pieces joined together to form a plate aperture.
Figure 19B:
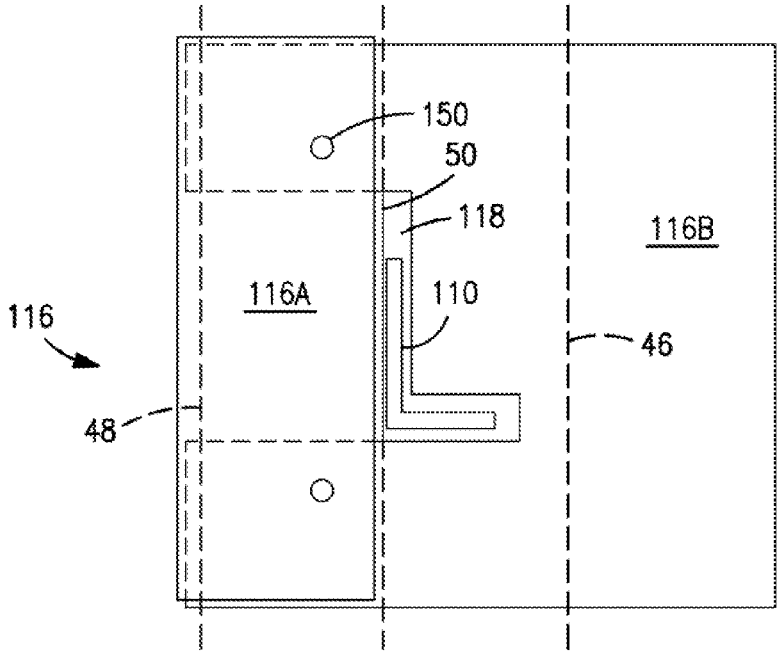

FIGS. 19A and 19B are upwardly-looking plan views of a 2-piece plate for use as or in the disclosed brace covers, FIG. 19A shows the two plate pieces 116A, 1168 separated from each other, with flange brace 110 positioned between the plate pieces. FIG. 19B shows the upstanding leg of brace 110 in surface-to-surface contact with web 44 of the purlin. A substantial portion of plate piece 116A overlies plate piece 116B, thus entrapping the brace between the two plate pieces at aperture 118. The two plate pieces joined to each other to form a two-piece plate having aperture 118, with the flange brace extending through the aperture and where the outline of the aperture generally conforms to the cross-section profile of the flange brace. The plate pieces are shown being fixedly held to each other in FIG. 19B by screws or rivets 150. If screws 150 are used to join the two plate pieces, the same screws can extend through both of the first and second plate pieces, and through bottom flange 48 of the purlin thus, as shown, mounting the brace cover to the purlin bottom flange with the same screws which are used to mount the two plate pieces to each other.

Figure 20A:
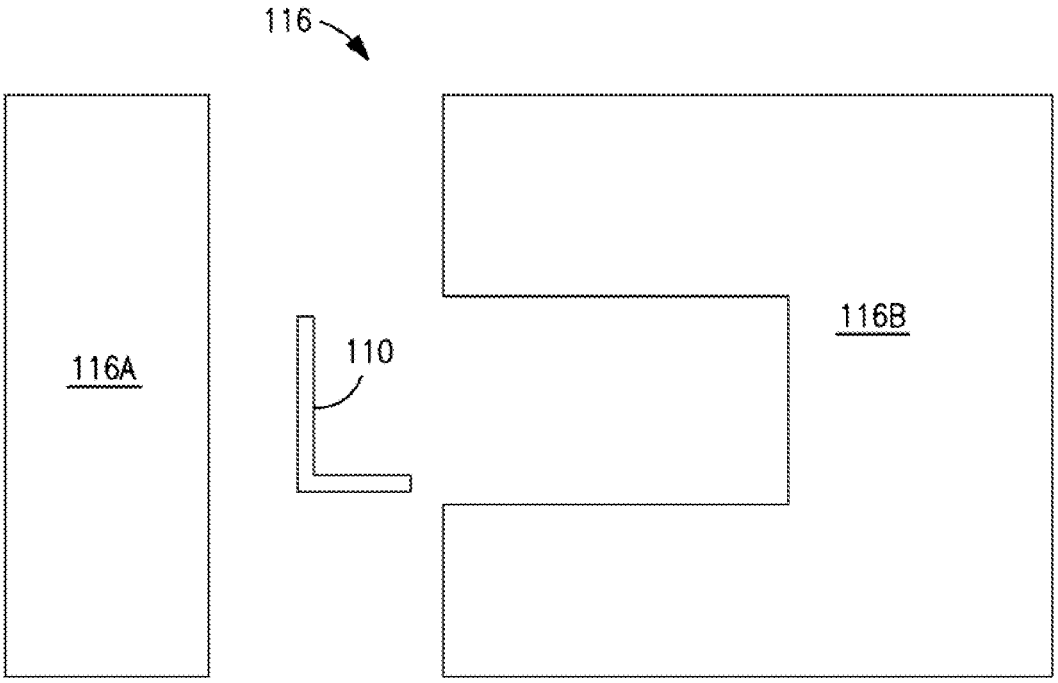
FIGS. 20A and 20B are upwardly-looking plan views similar to FIGS. 19A and 19B but for another embodiment of a 2-piece plate.
Figure 20B:
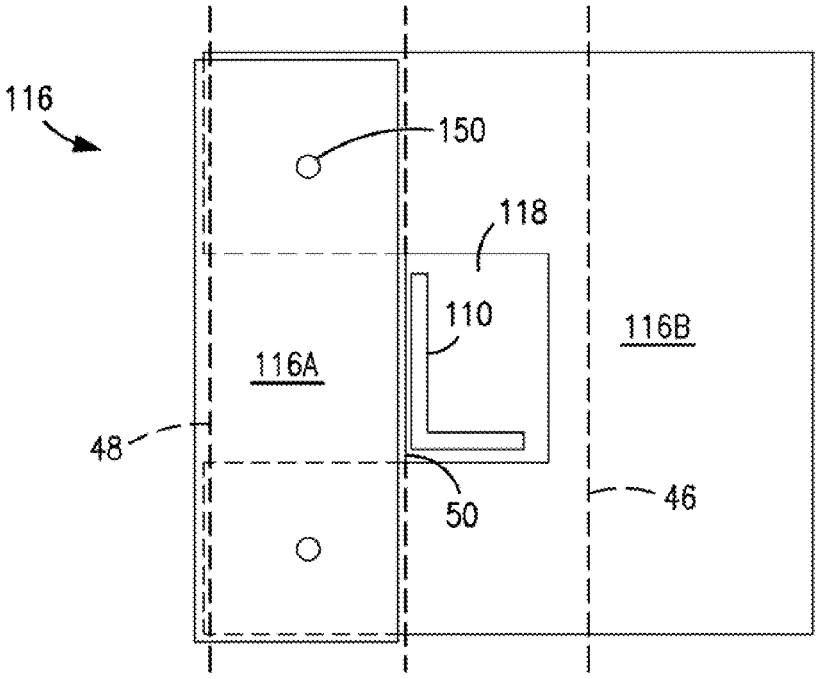

FIGS. 20A and 20B are upwardly-looking plan views similar to FIGS. 19A and 19B but for another embodiment of a 2-piece plate. FIG. 20A shows the two plate pieces 116A, 116B separated from each other, with flange brace 110 positioned between the plate pieces. FIG. 20B shows the upstanding leg of brace 110 in surface-to-surface contact with web 50 of the purlin. A substantial portion of plate piece 116A overlies plate piece 116B, thus entrapping the brace between the two plate pieces at aperture 118. The two plate pieces are joined to each other to form a two-piece plate having aperture 118, with the flange brace extending through the aperture and where the outline of the aperture differs substantially from the cross-section profile of the flange brace. The plate pieces are shown being fixedly held to each other in FIG. 20B by screws or rivets 150. The embodiment of FIGS. 20A, 20B finds particular utility in providing cover plate pieces which will accommodate a wide variety of flange brace cross-sections.

Figure 21A:
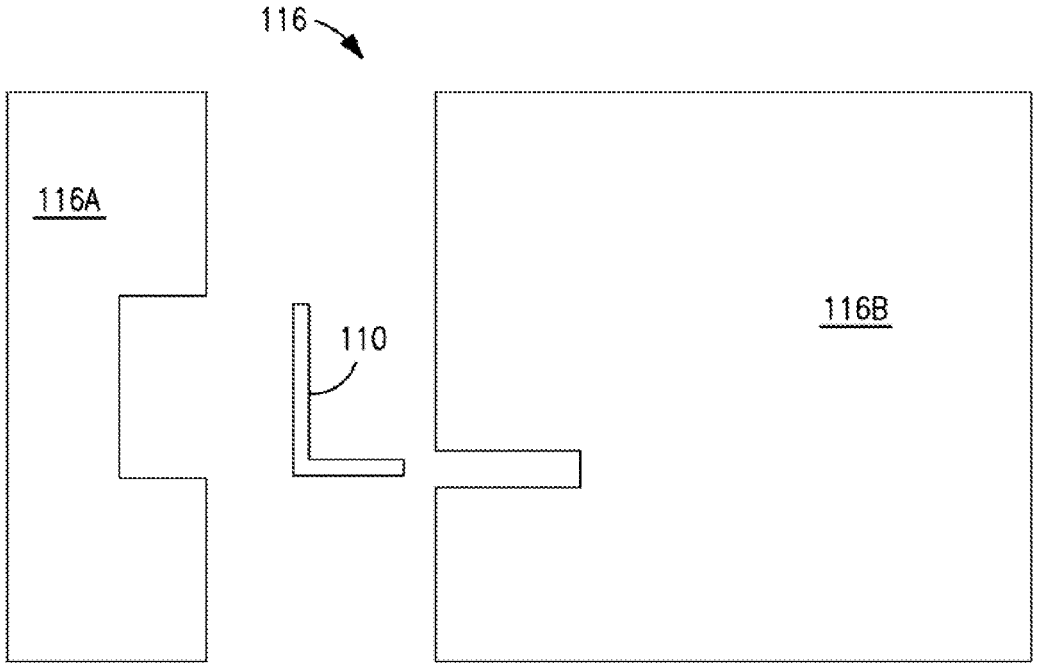
FIGS. 21A and 21B are upwardly-looking plan views similar to FIGS. 19A and 19B but for still another embodiment of a 2-piece plate.
Figure 21B:
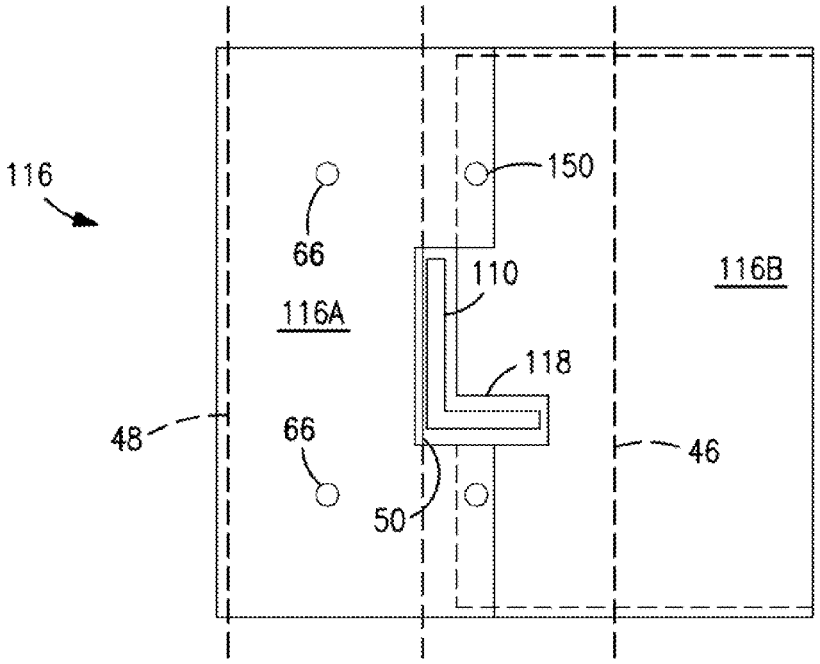

FIGS. 21A and 21B are upwardly-looking plan views similar to FIGS. 19A and 19B but for still another embodiment of a 2-piece plate. In the embodiment of FIGS. 21A, 21B, plate piece 116A has a recess which accommodates the upstanding leg of brace 110, and plate piece 116B has a recess which receives the transversely-extending leg of brace 110. FIG. 21A shows the plate pieces spaced from each other with brace 110 between the two plate pieces.

FIG. 21B shows the upstanding leg of brace 110 in surface-to-surface contact with web 50 of the purlin. A small portion of plate piece 116A overlies plate piece 116B, thus entrapping the brace between the two plate pieces at aperture 118. The two plate pieces are joined to each other by screws or rivets 150 to form a two-piece plate having aperture 118, with the flange brace extending through the aperture and where the outline of the aperture substantially conforms to the cross-section profile of the flange brace. The thus-assembled 2-piece plate is shown as having been mounted to bottom flange 48 of the purlin by screws 66. Thus, the two-piece plate of FIG. 21B employs both screws/rivets 150 and screws 66.

Figure 22:
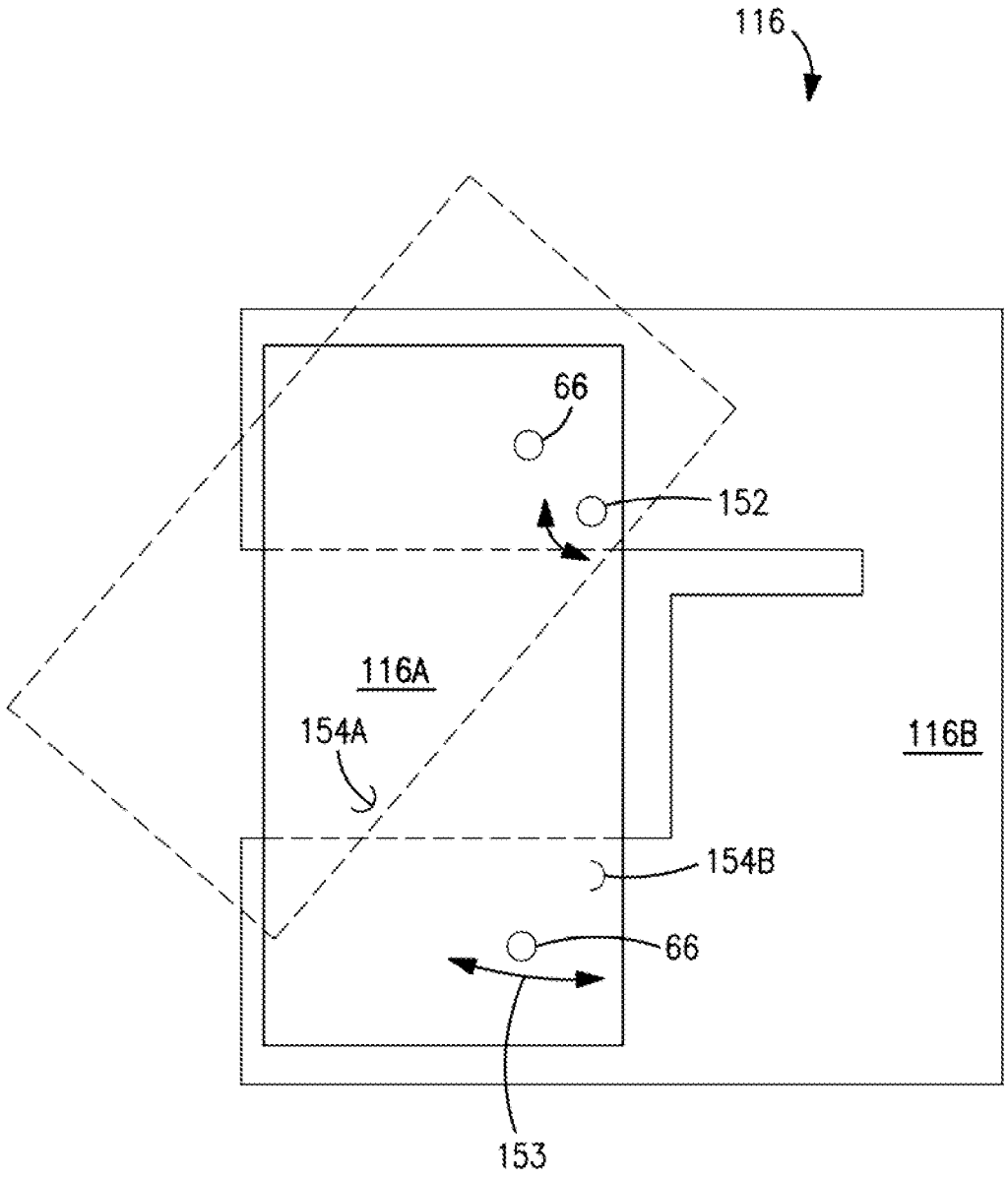
FIG. 22 is an upwardly-looking plan view of a 2-piece plate similar to FIGS. 19A and 19B, but the two plate pieces are pivotably connected together so that one piece can rotate relative to the other, and a detent mechanism is provided to temporarily lock to two pieces together, until screws can secure the closed combination to the flange of a purlin.

FIG. 22 is an upwardly-looking plan view of another embodiment of 2-piece plates. In the embodiments illustrated in FIG. 22, the two plate pieces are pivotably connected together by a pivot pin 152 so that plate piece 116A can rotate relative to plate piece 116B as indicated by double-headed arrow 153, and a detent mechanism 154A, 154B or other capture structure is provided to temporarily lock two pieces together, until screws 66 can be driven through both plate pieces and the bottom flange of the purlin, thus to secure the closed combination closed, and to secure the cover plate to the bottom flange of the overlying purlin.

Two piece plate covers illustrated in FIGS. 19-22 have the advantage of not needing to be mounted to the flange brace before the upper end of the flange brace is extended through fabric 32.

Although the invention has been described with respect to various embodiments, the invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to certain preferred embodiments, the reader will readily understand that the invention is adaptable to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. As part of a primary building support structure, a building roof structure overlying an interior of a building, said building roof structure, comprising:

(a) rafters and purlins, the purlins extending transversely across the rafters such that the rafters support the purlins;

(b) a suspension fabric extending across said roof structure such that said suspension fabric extends across tops of said rafters and below said purlins, said suspension fabric having an upper side facing toward said purlins, and an opposing lower side facing into the interior of the building;

(c) braces connecting at least some of said purlins to at least some of said rafters, each said brace and the respective said purlin to which said brace connects defining a brace/purlin combination, each said brace extending through a corresponding opening in said suspension fabric; and (d) for at least some of said brace/purlin combinations, a brace cover having a cover opening through which the respective brace extends, the brace cover being disposed below the lower side of said suspension fabric such that an intervening portion of said suspension fabric is between said brace cover and the respective said purlin, said brace cover being secured to a member of such primary building support structure.

2. The structure as in claim 1, said purlins having lower flanges, support bands underlying said suspension fabric, ones of said support bands being secured to said lower flanges of respective overlying ones of said purlins and thereby holding said suspension fabric in place against said lower flanges of said purlins, and wherein, for at least some of said brace/purlin combinations, said brace cover is supported by attachment of said brace cover to said lower flange of the respective said purlin.

3. The structure as in claim 1 wherein, for at least some of said brace/purlin combinations, said purlin has a central web disposed between a purlin upper flange and a purlin lower flange, and said brace is attached to said central web of said purlin.

4. The structure as in claim 1 wherein at least one of said brace/purlin combinations further comprises a tube sealant applied to both said brace and said brace cover at the cover opening so as to bridge and seal a space between said brace and said brace cover.

5. The structure as in claim 1 wherein, for at least some of said brace/purlin combinations, said brace cover having an unbroken outer perimeter which is displaced from the suspension fabric opening about an entirety of the fabric opening.

6. The structure as in claim 5 wherein at least some of said brace/purlin combinations further comprise one or more pieces of tape applied to said suspension fabric to patch, to thereby at least partially close, the suspension fabric opening, each said piece of tape being applied over less than all of the suspension fabric opening.

7. The structure as in claim 5 wherein a tube sealant is applied to both said brace cover and said suspension fabric, and bridges and seals a laterally-extending space between said brace cover and said suspension fabric.

8. The structure as in claim 7 wherein said tube sealant defines a closed loop path, spaced from the suspension fabric opening, which closed loop path encompasses the suspension fabric opening and seals to both said suspension fabric and said brace cover thereby to protect against lateral infiltration between said brace cover and said suspension fabric.

9. The structure as in claim 8 wherein the unbroken outer perimeter of said brace cover, displaced from the suspension fabric opening, defines a closed loop path which fully encompasses the closed loop path of said tube sealant.

10. The structure as in claim 1 wherein, for at least one of said brace/purlin combinations, said brace cover comprises a plate, and said plate has a plate aperture which forms a portion, but less than all, of the cover opening.

11. The structure as in claim 10 wherein at least one said plate has a 1-piece construction.

12. The structure as in claim 10 wherein at least one said plate is comprised of first and second plate pieces, and wherein said first plate piece defines a first portion of the plate aperture and said second plate piece defines a second different portion of the plate aperture.

13. The structure as in claim 12, wherein in at least one said plate, said first plate piece is attached to said second plate piece.

14. The structure as in claim 10 wherein the plate aperture has a first L-shaped profile and, when said plate and brace are installed such that said plate is attached to the associated said purlin and said brace is attached to the associated said rafter and purlin, the plate aperture defines a reference plane, and a cross-section of said brace in the reference plane has a second different L-shaped profile.

15. The structure as in claim 10 wherein said brace cover of at least one of said brace/purlin combinations also comprises a fabric piece attached to said plate.

16. The structure as in claim 10 wherein said cover plate has first and second opposing major surfaces, the first major surface facing said purlin, and wherein said brace cover further comprises a fabric piece mounted to the second major surface of said plate.

17. The structure as in claim 10 wherein said plate has a thickness of at least 0.01 inch and wherein said plate aperture is an L-shaped aperture having a first leg at least 1.5 inches long and a second leg at least 1.5 inches long.

18. The structure as in claim 10, a fabric piece being attached to said plate such that said fabric piece covers said aperture, said fabric piece, except for penetrations made after attachment of said fabric piece to said plate, being imperforate at least in a region corresponding to the plate aperture.

19. The structure as in claim 17, a fabric piece being attached to said plate such that said fabric piece covers said plate aperture, said fabric piece, except for penetrations made after attachment of said fabric piece to said plate, being imperforate at least in a region corresponding to the plate aperture.

20. The structure as in claim 15 wherein said brace cover, after installation of said brace cover into said building roof structure, comprises a fabric piece opening in said fabric piece.

21. The structure as in claim 20, further comprising a tube sealant applied at a juncture of said brace and said brace cover at the cover opening thereby to provide a barrier against ambient air passing through the cover opening.

22. A building roof structure, comprising building structural roof elements including at least first and second rafters, a space between said first and second rafters defining a first distance between said first and second rafters, each said rafter having opposing first and second ends, said roof structure further comprising an eave, having a length, and extending between the first ends of said first and second rafters, a ridge, having a length, and extending between the second ends of said first and second rafters, and a second distance between said eave and said ridge, said eave and said ridge being disposed on, extending transverse to, and being connected to, said first and second rafters, and a plurality of intermediate purlins extending between said first and second rafters and spaced from each other between said eave and said ridge, said intermediate purlins being disposed on, and extending transverse to, said first and second rafters, the building roof structure further comprising:

(a) a first set of support bands extending from said first rafter to said second rafter and being connected to said building structural roof elements, said first set of support bands being spaced along the lengths of said first and second rafters;

(b) a second set of support bands extending from said eave toward said ridge and under said intermediate purlins, said second set of support bands having first and second end portions and being spaced from each other between said first and second rafters;

(c) a suspension fabric overlying, and being supported by, said first and second sets of support bands, said suspension fabric being attached to structural members of said building;

(d) a plurality of braces which collectively connect at least some of such intermediate purlins to one or both of such first and second rafters, each said brace extending through a corresponding fabric opening in the suspension fabric; and (e) for each brace which connects a given said purlin to a given said rafter, a brace cover having a cover opening through which the respective said brace extends, said brace cover having a perimeter which encircles the fabric opening through which said brace extends, said brace cover comprising a cover plate, and a fabric piece attached to said cover plate.

23. The building roof structure as in claim 22, said brace cover comprising a cover plate, said cover plate having a plate aperture which forms a portion, but less than all, of the cover opening.

24. The building roof structure as in claim 23 wherein said cover plate has first and second opposing major surfaces, the first major surface facing an overlying said purlin, and wherein said fabric piece is disposed on the second major surface.

25. The building roof structure as in claim 24, said cover opening further comprising a fabric piece opening in said fabric piece.

26. The building roof structure as in claim 25, further comprising a tube sealant, applied at a juncture of said brace and said brace cover at the cover opening, and bridging and sealing a space between said brace cover and said suspension fabric.

27. A brace cover suitable for use in a building roof structure which includes building roof structure braces, said brace cover comprising:

(a) a cover plate having a thickness, and having a plate aperture extending through the thickness of said cover plate, the aperture being sized to receive a building roof structure brace; and (b) a fabric piece attached to said plate such that said fabric piece covers the plate aperture, said fabric piece being imperforate at least in a region corresponding to the plate aperture such that the fabric piece seals the aperture.

28. The brace cover as in claim 27 in an entirety of said fabric piece is imperforate.

29. A fabric suspension kit or use in a building roof structure, said fabric suspension kit comprising:

(a) at least one length of support banding suitable for extending a first set of support bands from a first rafter of a building to a second rafter of such building, and a second set of support bands, for crossing said first set of support bands and extending from an eave of such building, under intermediate purlins, to a ridge of such building;

(b) a suspension fabric suitable for extending from such first rafter to such second rafter and from such eave to such ridge, with said first and second sets of support banding supporting said suspension fabric; and (c) a plurality of brace covers adapted and configured to extend about braces which are secured to ones of such rafters and ones of such purlins, at least one said brace cover comprising a cover plate, a plate aperture extending throat said cover plate, and a fabric piece which is one of attached to, or readily attachable to, said cover plate thereby to extend over the plate aperture, and wherein, when said brace cover is mounted in such building roof structure, such brace extends through a cover opening in said brace cover, such cover opening comprising the plate aperture and a fabric piece opening in said fabric piece.

30. The fabric suspension kit as in claim 29, further comprising a supply of tube sealant for bridging and sealing between at least one of (i) said brace cover and a respective such brace at the plate aperture, and (ii) said brace cover and said suspension fabric at a laterally-extending space extending about the plate aperture.

* * * * *